US007620339B2

(12) United States Patent
Kubo

(10) Patent No.: US 7,620,339 B2
(45) Date of Patent: Nov. 17, 2009

(54) IMAGE FORMING APPARATUS INCLUDING FIRST AND SECOND CLEANING MEMBERS

(75) Inventor: Norihiko Kubo, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 541 days.

(21) Appl. No.: 11/466,700

(22) Filed: Aug. 23, 2006

(65) Prior Publication Data

US 2007/0047992 A1 Mar. 1, 2007

(30) Foreign Application Priority Data

Sep. 1, 2005 (JP) ..... 2005-253599

(51) Int. Cl.
*G03G 15/01* (2006.01)
*G03G 15/16* (2006.01)
*G03G 15/24* (2006.01)

(52) U.S. Cl. ..... 399/71; 399/101; 399/149; 399/299

(58) Field of Classification Search ..... 399/71, 399/99, 101, 149, 150, 223, 299, 302, 344
See application file for complete search history.

(56) References Cited

U.S. PATENT DOCUMENTS

| | | | | |
|---|---|---|---|---|
| 6,885,473 | B2 * | 4/2005 | Tsuruya | 358/1.18 |
| 6,950,620 | B2 | 9/2005 | Yoshikawa et al. | 399/129 |
| 7,177,569 | B2 * | 2/2007 | Kamimura | 399/149 |
| 7,206,523 | B2 * | 4/2007 | Watanabe et al. | 399/12 |
| 7,239,827 | B2 * | 7/2007 | Furukawa | 399/149 |
| 2003/0049048 | A1 | 3/2003 | Yoshikawa et al. | 399/129 |
| 2007/0127944 | A1 * | 6/2007 | Mochizuki | 399/101 |
| 2008/0069590 | A1 * | 3/2008 | Shigehiro | 399/149 |

FOREIGN PATENT DOCUMENTS

| | | | |
|---|---|---|---|
| JP | 05053414 | A * | 3/1993 |
| JP | 2001-188393 | | 7/2001 |
| JP | 2003-156982 | | 5/2003 |
| JP | 2003-173062 | | 6/2003 |
| JP | 2003173062 | A * | 6/2003 |
| JP | 2004-117599 | | 4/2004 |

* cited by examiner

*Primary Examiner*—Robert Beatty
(74) *Attorney, Agent, or Firm*—Fitzpatrick, Cella, Harper & Scinto

(57) ABSTRACT

An image forming apparatus includes a first image forming station including an image bearing member, developing means for developing an electrostatic image formed on the image bearing member with toner, wherein the toner remaining on the image bearing member after a developed image is transferred, is collected by the developing means; a transfer rotatable member; a first cleaning member for removing toner from the transfer rotatable member; a second image forming station including an image bearing member, developing means for developing an electrostatic image formed on the image bearing member with toner, a second cleaning member for removing the toner remaining on the image bearing member after a developed image is transferred, wherein the second image forming station is disposed downstream of the first image forming station and upstream of the second cleaning member with respect to a peripheral moving direction of rotation of the transfer rotatable member; and collection control means for a control operation to collect, by the second cleaning member of the second image forming station, the toner discharged to the transfer rotatable member from the first image forming station during a non-image-formation period.

19 Claims, 7 Drawing Sheets

100 A4 SHEETS

| | s | α2 | α1 | β2 | β1 | IMAGE EVACUATION |
|---|---|---|---|---|---|---|
| EMB.1 | 3 | 40% | 30% | 5% | 10% | GOOD |
| EMB.2 | 3 | 30% | 10% | 5% | 10% | GOOD |
| EMB.3 | 3 | 30% | 5% | 5% | 10% | GOOD |
| EMB.4 | 3 | 10% | 5% | 0.5% | 5% | GOOD |
| EMB.5 | 3 | 40% | 30% | 5% | NO COLLECTION | BACK SIDE CONTAMINATION |
| COMP.1 | 3 | 40% | NO EXPULSION | 5% | 10% | DUE TO TURNING-UP OF BLADE |

FIG.5

100 A4 SHEETS

| | s | α2 | α1 | β2 | β1 | IMAGE EVACUATION |
|---|---|---|---|---|---|---|
| COMP.3 | 3 | 10% | 30% | 5% | 10% | DUE TO TURNING-UP OF BLADE |
| COMP.4 | 3 | 0% (100 SHEETS OF 10%-IMAGE IN 5000 SHEETS) | 20% | 5% | 10% | DUE TO TURNING-UP OF BLADE |

FIG.6

100 A4 SHEETS

| | EXPULSION TIMES (S) | EXPULSION | $\alpha 2$ | $\alpha 1$ | $\beta 2$ | $\beta 1$ | IMAGE EVACUATION | |
|---|---|---|---|---|---|---|---|---|
| EMB.5 | 1.5(S) | $t1 \rightarrow t1 \times (1-\beta 2 / \beta 1)$ | 0% ※ | 30% | 5% | 10% | GOOD | (MONOCHROMATIC BLACK MODE) |
| EMB.6 | 2.25(S) (HIGH IMAGE RATIO COLORS IS SELECT) | $t1 \rightarrow N(t1 \times (1-\beta 2 / \beta 1))$ | 0% ※ | 30% | 7.5% | 10% | GOOD | (MONOCHROMATIC BLACK MODE) |
| EMB.7 | 3(S) | $tL \rightarrow t1$ | 30% | 30% | 5% | 10% | DUE TO TURNING-UP OF BLADE SEVERAL HUNDREDS SHEETS AFTER EVACUATION OF TONER | |

※100 SHEETS OF 10%-1MAGE IN 5000 SHEETS

FIG.7

IMAGE FORMING APPARATUS INCLUDING FIRST AND SECOND CLEANING MEMBERS

FIELD OF THE INVENTION AND RELATED ART

The present invention relates to an image forming apparatus, such as a copying machine, a printing machine, a facsimile machine, a multifunction machine capable of performing the functions of the preceding machine, etc.

In particular, the present invention relates to an image forming apparatus which has multiple image formation stations aligned in parallel in the moving direction of its intermediary transferring member; forms multiple toner images (different in color) on the multiple image bearing members of the image formation stations, one for one; sequentially transfers (primary transfer) in layers the multiple toner images, onto its moving intermediary transferring member; and transfers (secondary transfer) the multilayered toner images on the intermediary transferring member, onto a recording medium, to form a full-color or multicolor image.

In Japanese Laid-open Patent Applications 2004-117599 and 2003-156982, an image forming apparatus having multiple image formation stations, each of which employs a cleaner-less electrophotographic system, is described.

The above-mentioned cleaner-less electrophotographic system is not provided with a cleaning apparatus dedicated to the removal of the transfer residual toner, that is, the toner remaining on a photosensitive member (image bearing member) after the primary transfer. Instead, it cleans the photosensitive drum with the developing means; it removes the transfer residual toner from the photosensitive member, with the use of developing means, at the same time as a latent image on the photosensitive drum is developed by the developing means. The removed transfer residual toner is collected and recycled.

Further, in order to enable the developing means to efficiently remove and collect the transfer residual toner, the cleaner-less electrophotographic system is provided with an auxiliary charging means for controlling the polarity of the transfer residual toner. In terms of the rotational direction of the photosensitive member, the auxiliary charging means is disposed downstream of the primary transfer station, and upstream of the charging means for charging the photosensitive member.

Further, in order to prevent the image forming apparatus from being reduced in performance by the toner trapped, being thereby accumulated, in the auxiliary charging means and photosensitive member charging means, the image forming apparatus is provided with a toner expulsion mode for periodically expelling the trapped toner from the auxiliary charging means and photosensitive member charging means, onto the photosensitive member. Thus, the auxiliary charging means and the photosensitive member charging means can be refreshed by operating the image forming apparatus in this toner expulsion mode. After being expelled onto the photosensitive member, the expelled toner is mostly collected into the developing means. However, the toner particles which are normal in polarity, but are insufficient in the amount of charge, and the toner particles which are reverse in polarity, sometimes fail to be completely collected. The toner particles having failed to be collected by the developing means transfer from the photosensitive drum onto the intermediary transferring member by being pressed upon the intermediary transferring medium, in the primary transfer station. Then, they are moved by the movement of the intermediary transferring member to the cleaning means for cleaning the intermediary transferring member, which is located downstream of the secondary transferring means, in terms of the moving direction of the intermediary transferring member. Then, they are removed from the intermediary transferring member by the intermediary transferring member cleaning means.

The toner particles having accumulated in the auxiliary charging member are generally smaller in diameter. Further, a substantial number of them have deteriorated because they have been repeatedly rubbed against the photosensitive member. Thus, it is possible that as the toner particles having accumulated in the auxiliary charging member are collected into the developing means, the developing means will be reduced in performance, affecting therefore the subsequent image forming operations. Therefore, some cleaner-less electrophotographic systems are structured so that the toner expelled from the auxiliary charging member in the toner expulsion mode is not collected by the developing means, and is transferred onto the intermediary transferring member, from which it is collected (removed) by the intermediary transferring member cleaning means.

In Japanese Laid-open Patent Applications 2001-188393 and 2003-173062, image forming apparatuses of the tandem type are described, in which cleaner-less image formation stations, and image formation stations having a cleaning apparatus, are mixedly disposed. The image forming apparatus described in Japanese Laid-open Patent Application 2001-188393 is structured so that only the image formation unit Y, which is the image formation unit for forming yellow monochromatic images, among the multiple image formation units Y, M, C, and K of the image forming apparatus, is enabled to send the residual toner collected by the cleaning apparatus, to the developing apparatus 26Y for recycle. Incidentally, the reference characters Y, M, C, and K in the preceding sentence stand for yellow, magenta, cyan, and black colors, respectively. In the case of the image forming apparatus described in Japanese Laid-open Patent Application 2003-173062, the primary transfer residual toner, that is, the toner having failed to be transferred in the cleaner-less image formation station, is collected by the developing means; it is not expelled onto the intermediary transferring member. Further, the secondary transfer residual toner, that is, the toner remaining on the intermediary transferring member after the secondary transfer, is collected by the image bearing member of the image formation station having a cleaning apparatus. Thus, this image forming apparatus is not provided with an apparatus for cleaning the intermediary transferring member.

Cleaner-less image forming apparatuses of the tandem type, such as those described above, in which multiple photosensitive members are aligned in parallel, are provided with a toner expulsion-and-collection mode in which toner is expelled from the cleaner-less image formation stations, and collected. In the case of the method in which the toner expelled onto the intermediary transferring member is collected by the intermediary transferring member cleaning station while the apparatus is operated in this toner expulsion-and-collection mode, the area of the intermediary transferring member, onto which the expelled toner was transferred, must be moved through the transfer station in which a toner image is transferred onto a recording medium. Therefore, the distance the expelled toner is moved to be collected is substantial, adding thereby to the length of time required for the toner expulsion-and-collection mode.

SUMMARY OF THE INVENTION

Thus, the primary object of the present invention is to reduce the time required to collect the toner having been excelled onto a rotational transferring member from the cleaner-less image formation station of an image forming apparatus of the tandem type.

According to an aspect of the present invention, there is provided an image forming apparatus comprising a first image forming station including an image bearing member, developing means for developing an electrostatic image formed on said image bearing member with toner, wherein the toner remaining on said image bearing member after a developed image is transferred, is collected by said developing means; a transfer rotatable member; a first cleaning member for removing toner from said transfer rotatable member; a second image forming station including an image bearing member, developing means for developing an electrostatic image formed on said image bearing member with toner, a second cleaning member for removing the toner remaining on said image bearing member after a developed image is transferred, wherein said second image forming station is disposed downstream of said first image forming station and upstream of said second transfer rotatable member with respect to a peripheral moving direction of rotation of said transfer rotatable member; and collection control means for a control operation to collect, by said second cleaning member of said second image forming station, the toner discharged to said transfer rotatable member from said first image forming station during a non-image-formation period.

These and other objects, features, and advantages of the present invention will become more apparent upon consideration of the following description of the preferred embodiments of the present invention, taken in conjunction with the accompanying drawings.

BRIEF DESCRIPTION OF THE DRAWINGS

FIG. 5 is a table summarizing the printing conditions in the first-fourth preferred embodiments, and the first and second comparative embodiments, and the results of the evaluation of the images formed under these conditions.

FIG. 6 is a table summarizing the printing conditions in the third and fourth comparative embodiments, and the results of the evaluation of the images formed under these conditions.

FIG. 7 is a table summarizing the printing conditions in the fifth and sixth embodiments, and the fifth comparative embodiment, and the results of the evaluation of the images formed under these printing conditions.

DETAILED DESCRIPTION OF THE PREFERRED EMBODIMENTS

Hereinafter, the preferred embodiments of the image forming apparatus in accordance with the present invention will be described in detail with reference to the appended drawings.

Embodiment 1

(1) Description of General Structure of Image Forming Apparatus

Figure 1:
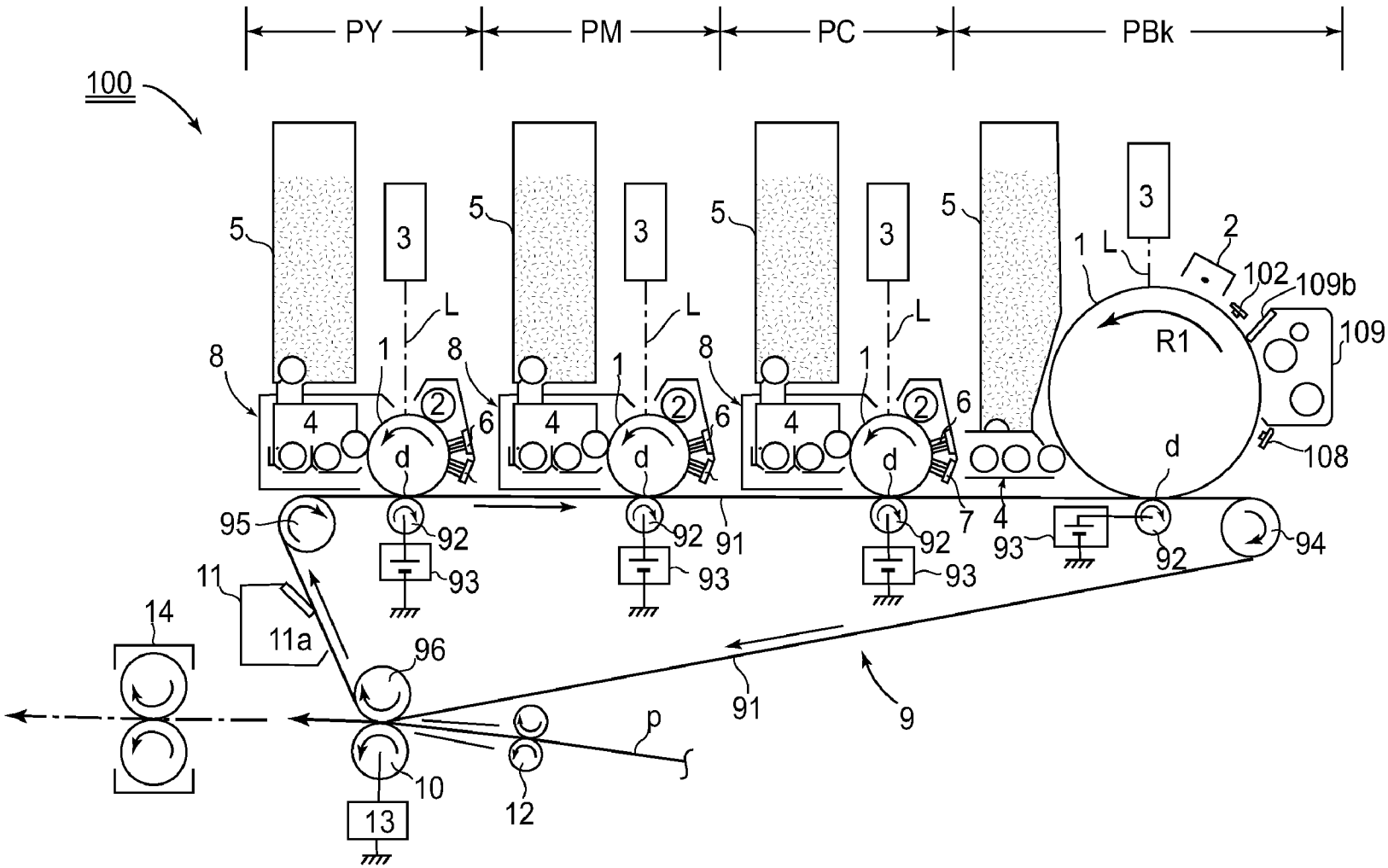
FIG. 1 is a schematic drawing of the color laser printer of the tandem type in the preferred embodiments of the present invention.

FIG. 1 is a drawing showing the general structure of the image forming apparatus in the first preferred embodiment of the present invention. The image forming apparatus 100 in this embodiment is a color laser printer of the transfer type. It is a printer of the inline type; it has four photosensitive drums (four image formation stations) aligned in parallel. The size of the largest sheet of recording medium conveyable through the printer is A3. To this image forming apparatus, an external host apparatus 150 (FIG. 2) such as an image reading apparatus and a personal computer is connected so that information is exchangeable between the image forming apparatus and external host apparatus. The image forming apparatus 100 is capable of forming (outputting) a full-color image on recording medium, such as recording paper, OHP sheet, and fabric, according to the image information inputted from the external host apparatus 150.

Figure 2:
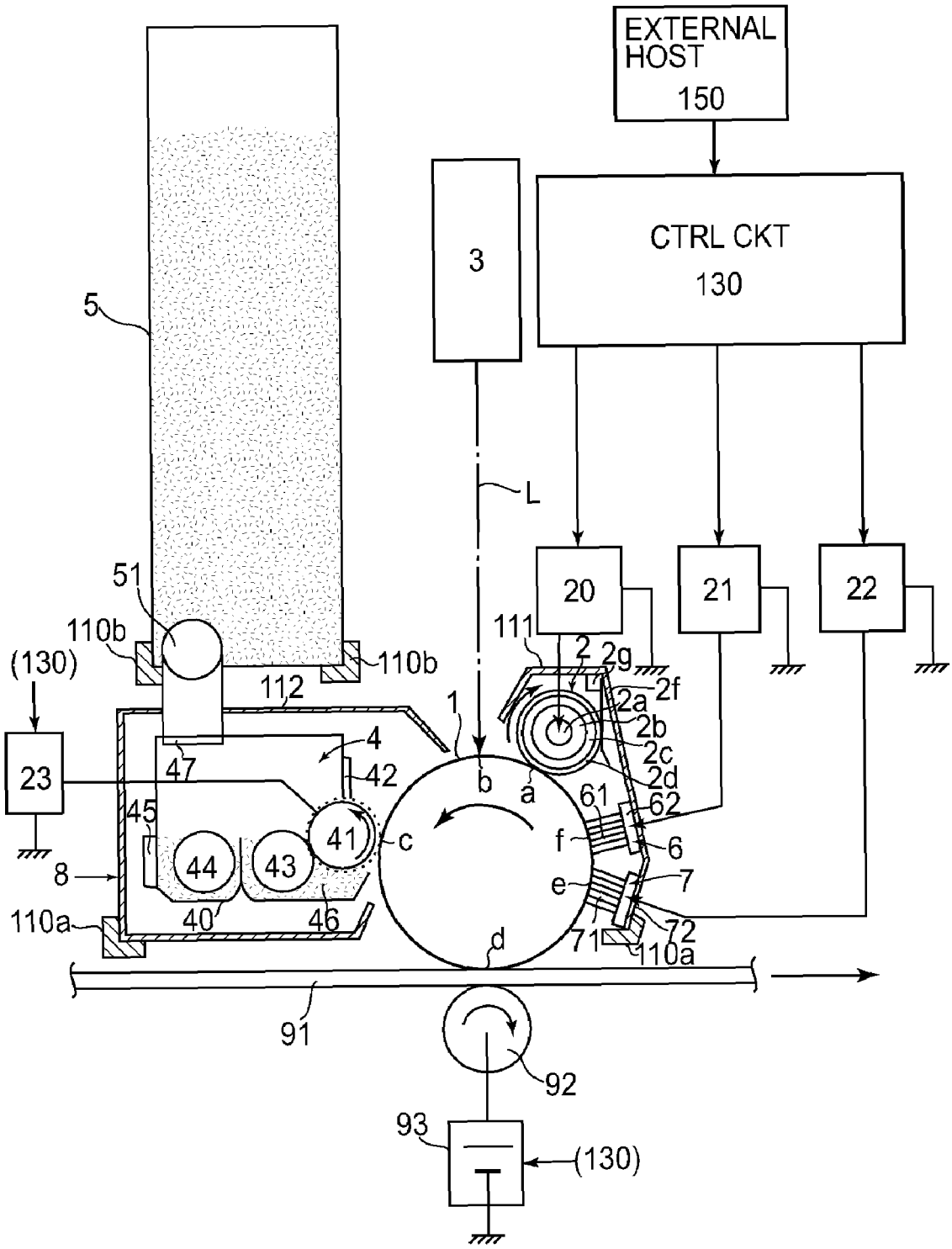
FIG. 2 is a schematic sectional view of the cleaner-less image formation station, showing the structural arrangement in the adjacencies of the peripheral surface of the photosensitive drum thereof.

Referring to FIG. 2, designated by a reference numeral 130 is a control circuit (CPU) as a controlling means which controls the overall operation of the image forming apparatus 100. This control circuit 130 processes signals which represent image information or the like inputted from the external host apparatus 150. Further, it is in charge of the processing the signals inputted from various processing devices of the image forming apparatus, processing of the command signals to be sent to the various processing devices, controlling of the power sources such as voltage applying means as the means for applying a voltage to the various processing devices, controlling of the preset sequences of the image forming operations, etc.

Referring to FIG. 1, designated by reference characters PY, PM, PC, and PBk are four image formation stations, that is, first to fourth image formation stations aligned in parallel in the listed order, from left to right of the drawing. The first-third image formation stations PY, PM, and PC are electrophotographic image formation stations which employ the cleaner-less electrophotographic system, as will be described later in detail. The fourth image formation station PBk is an electrophotographic image formation station provided with a cleaning apparatus 109, as will also be described later.

Each of the image formation stations PY, PM, PC, and PBk has an electrophotographic photosensitive member 1 (which hereinafter will be referred to as photosensitive drum), as an image bearing member, which is rotationally driven at a preset velocity in the counterclockwise direction indicated by an arrow mark. The four image formation stations are in charge of the formation of toner images of yellow (Y), magenta (M), cyan (C), and black (Bk) color components, one for one, into which an intended color image is separated.

In this embodiment, the fourth image formation station PBk, that is, the image formation station provided with the cleaning apparatus, is the most downstream image formation station among the above-mentioned multiple image formation stations PY, PM, PC, and PBk. Further, in terms of the order in which they are used when a multicolor image is formed, it is the last image formation station. In terms of the rotational direction of the intermediary transferring member, it is disposed upstream of the secondary transfer roller as a transferring member.

When the image forming apparatus is operated in the full-color mode (color print mode) based on the four primary colors, the image information signals inputted into the control circuit 130 from the external host apparatus 150 are converted into video signals, which correspond to the color components, of which the intended color image is composed. In response to these video signals, toner images of yellow, magenta, cyan, and black colors are formed in the image formation stations PY, PM, PC, and PBk, respectively.

The four toner images, different in color, formed on the four photosensitive drums in the four image formation stations, one for one, are sequentially transferred in layers onto an intermediary transfer belt 91, which is being moved. More specifically, the intermediary transfer unit 9, as a transferring means, is disposed so that it opposes the photosensitive drum 1 of each of the image formation stations PY, PM, PC, and PBk. In the intermediary transfer unit 9, the intermediary transfer belt 91 (which hereinafter will be referred to as belt 91), which is flexible and endless, is stretched around a driver roller 94, a tension roller 95, and a belt-backing roller 96 so that the intermediary transfer belt 91 is provided with a preset amount of tension. The belt-backing roller 96 is disposed so that it opposes the secondary transfer roller. As the material for the belt 91, a resin belt, a rubber belt, a resin belt with a metallic core, a rubber belt with a metallic core, and the like are preferable. Obviously, a belt having an elastic layer may be employed in consideration of the improvement of the image forming apparatus in terms of the prevention of the scattering of toner, the prevention of the formation of images suffering from black (white) spots, etc. In this embodiment, a resin belt formed of the material created by dispersing carbon particles in PI (polyimide) so that its volumetric resistivity is in the order of $10^8$ ohm.cm, is used. It is 80 μm in thickness, 320 mm in width, and 900 mm in circumference.

The belt 91 is rotationally driven by the driver roller 94 in the clockwise direction indicated by the arrow mark in the drawing at roughly the same velocity as the peripheral velocity of the photosensitive drum 1. The toner image formed in each of the image formation stations PY, PM, PC, and PBk enters the primary transfer station d (transfer nip), in which the photosensitive drum 1 opposes the belt 91. In each transfer station d, a primary transfer roller 92, as the primary transferring member, is in contact with the inward side of the belt 91, in terms of the loop which the belt 91 forms. As the primary transfer roller 92, a roller made up of an electrically conductive sponge is used. The primary transfer roller 92 is no more than $10^5$ ohm in electrical resistance, 16 mm in external diameter, and 315 mm in length. In order to render the primary transfer roller 92 of each of the image formation stations PY, PM, PC, and PBk independent from the others in terms of the primary transfer bias, multiple primary transfer bias power sources 92, as voltage applying means, are provided, which are connected to the primary transfer rollers 92, one for one.

As the belt 91 is rotationally driven, first, a yellow toner image, that is, the toner image of the first color, is transferred onto the portion of the belt 9, which is moving in the primary transfer station d of the image formation station PY, that is, the first image formation station. Next, while the portion of the belt 9, onto which the yellow toner image has just been transferred, is moved through the primary transfer station d of the second image formation station PM, the a magenta toner image, that is, the toner image of the second color is transferred onto this portion of the belt 91 in a manner to be layered on the yellow toner image. Next, while the portion of the belt 9, onto which the yellow and magenta toner images have just been transferred in layers, is moved through the primary transfer station d of the third image formation station PC, a cyan toner image, that is, the toner image of the third color is transferred onto this portion of the belt 91 in a manner to be layered on the yellow and magenta toner images. Next, while the portion of the belt 9, onto which the yellow, magenta, and cyan toner images have just been transferred in layers, is moved through the primary transfer station d of the fourth image formation station PBk, a black toner image, that is, the toner image of the fourth color, is transferred onto this portion of the belt 91 in a manner to be layered on the yellow, magenta, and cyan toner images. In other words, the yellow, magenta, cyan, and black toner images are sequentially transferred in layers (multilayer transfer) onto the belt 91, effecting thereby an unfixed synthetic full-color image.

In this embodiment, in consideration of the transfer efficiency with which the toner (negative toner) having been transferred onto the exposed points (which is −150 V in potential) of the photosensitive drum 1 is transferred onto the belt 91, +350 V is applied as the primary transfer bias to the primary transfer roller 92 of each of the image formation stations for the first to third colors. To the primary transfer roller 92 of the image formation station of the fourth color, +1,500 V is applied, as will be described later in detail.

Then, the unfixed full-color toner image effected on the belt 9 is conveyed by the subsequent movement of the belt 91 to the secondary transfer station, in which the belt 91 opposes the second transfer roller 10 as a second transferring member. The second transfer roller 10 is disposed so that it is kept pressed against the belt-backing roller 96, with the belt 91 sandwiched the two rollers 10 and 96. The compression nip formed between the belt 91 and secondary transfer roller 10 is the second transfer station. To the secondary transfer roller 10, a secondary transfer bias power source 13 as a voltage applying means is connected.

Meanwhile, sheets of a recording medium P (which hereinafter will be referred to simply as recording medium P) are fed into the main assembly of the image forming apparatus, while being separated one by one, from an unshown paper feeding mechanism. As each recording medium P is conveyed further into the main assembly, the leading edge of the recording medium P is caught by the nip formed between a pair of registration rollers 12, which are not rotating at this stage of the image forming operation. As a result, the recording medium P is corrected in attitude, if it has been conveyed askew. Then, the recording medium P is conveyed by the rotation of the pair of registration rollers 12 with a preset control timing. More specifically, the timing with which the rotation of the pair of registration rollers 12 is started is controlled so that the arrival of the leading edge of the unfixed full-color toner image effected on the belt 91 at the secondary transfer station will coincide with the arrival of the print start line of the recording medium P at the second transfer station. Then, while the recording medium P is conveyed, while remaining pinched between the two rollers 10 and 92, through the second transfer station, the four unfixed toner images, different in color, (which have effected unfixed full-color toner image) on the belt 91 are transferred all at once (secondary transfer) onto the recording medium P.

After coming out of the secondary transfer station, the recording medium P is separated from the belt 91 by the curvature of the belt 91, and is introduced into a fixing apparatus 14 of the roller type, as a fixing means. The fixing apparatus 14 of the roller type has a rotational fixation roller (heat roller) and a rotational pressure roller, which are kept pressed against each other, forming a fixation nip through which the recording medium P is conveyed while remaining pinched between the heat and pressure rollers. While the recording medium P is conveyed through the fixation nip, it is subjected to heat and pressure. As a result, the four toner images of yellow, magenta, cyan, and black colors, one for one, are melted, mixed, and fixed to the surface of the transfer medium P, yielding thereby a permanent full-color print (copy) of the intended image. After the fixation, the recording medium P is discharged from the image forming apparatus. Meanwhile, the belt 91 is cleaned to be prepared for the next image formation process; the secondary transfer residual toner on the belt 91 is removed by a cleaning blade 11*a*, as a cleaning means, with which a belt cleaner 11 is provided.

When the image forming apparatus is operated in the black monochromatic image formation mode (black monochromatic mode), only the fourth image formation station PBk, as the black image forming station, operates for image formation. The first-third image formation stations PY, PM, and PC do not operate for image formation, even though their photosensitive drums 1 are rotationally driven. The black toner image formed on the photosensitive drum 1 of the fourth image formation station PBk is transferred (primary transferred) onto the belt 9. Then, this toner image is transferred (secondary transfer) onto the recording medium P in the second transfer station. After coming out of the secondary transfer station, the recording medium P is separated from the belt 9 by the curvature of the belt 9, and is introduced into the fixing apparatus 14 of the roller type, in which the toner image is fixed. Then, the recording medium P is discharged as a black monochromatic copy from the image forming apparatus.

(2) First-Third Image Formation Stations PY, PM, and PC

The first-third image formation stations PY, PM, and PC are identical in mechanical structure, although they differ in the color of the developers (toners) they use; they use yellow, magenta, and cyan developers (toners), respectively. FIG. 2 is an enlarged view of the electrophotographic system which makes up each of these image formation stations.

The photosensitive drum 1 is rotationally driven. While it is rotationally driven, its peripheral surface is uniformly charged by a charging means 2 to a preset polarity and potential level. The uniformly charged surface of the photosensitive drum 1 is exposed by an exposing means 3 in the pattern of an intended image. As a result, an electrostatic latent image which corresponds to the pattern of exposure is formed on the surface of the photosensitive drum 1. This electrostatic latent image is developer by a developing means 4 into a toner image. The toner image is transferred onto the belt 91, in the primary transfer station d, as described before.

This image formation station is not provided with a cleaning apparatus dedicated to the removal of the transfer residual toner, that is, the toner which is not transferred onto the belt 91 and remains on the surface of the photosensitive drum 1.

Basically, the transfer residual toner, that is, the toner which is not transferred from the photosensitive drum 1 onto the belt 91 and remains on the surface of the photosensitive drum 1, is collected by an auxiliary charging means 7 as a means for diffusing (uniformly dispersing) the residual toner. A small amount of the residual toner which slips by the residual toner diffusing means 7 is adjusted in electric charge by a controlling means 6, as the second auxiliary charging means, for controlling the amount of toner charge. Then, this small amount of toner, which has been adjusted in the amount of charge, is conveyed by the subsequent rotation of the photosensitive drum 1 to the developing means 4, by which it is collected while the developing means is in action (residual toner collection coincidental with development). This process of collecting this small amount of transfer residual toner will be described later in detail. Here, the diffusion of the transfer residual toner by the residual toner diffusing means 7 connotes evenly spreading the body of residual toner, which formed the remnant of the transferred toner image.

As for the toner particles which have accumulated in the auxiliary charging means 7 and 6 by being trapped by the auxiliary charging means 7 and 6, they are expelled onto the photosensitive drum 1, in the preset expulsion-and-collection control mode which is carried out with opportune timing. Then, they are transferred onto the belt 91, and are collected onto the photosensitive drum 1 in the fourth image formation station PBk provided with a cleaning apparatus 109. This expulsion-and-collection control mode will also be described later in detail.

In this embodiment, the above-mentioned photosensitive drum 1, charging means 2, and auxiliary charging means 7 and 6 are integrally disposed in a charging unit frame 111, making up the charging unit, and the developing means 4 is disposed in a development unit frame 112, making up the development unit. Further, the charging unit and development unit are integrated in the form of a process cartridge 8 (which sometime hereinafter will simply be referred to as a cartridge) which is removably mountable in the main assembly of the image forming apparatus (which hereinafter may be referred to as the apparatus main assembly).

The cartridge 8 is removably mounted into the apparatus main assembly. While it is mounted, it is guided by a cartridge guiding means 110*a*. As the cartridge 8 is mounted into the apparatus main assembly, the driving means (unshown) with which the apparatus main assembly is provided engages with the driving force transmitting means (unshown) of the cartridge 8, making it possible for the photosensitive drum 1, developing means 4, etc., to be driven. Also as the cartridge 8 is mounted into the apparatus main assembly, the electrical contacts with which the cartridge 8 is provided and the electrical contacts with which the apparatus main assembly is provided, couple with each other, establishing electrical connection between the cartridge 8 and apparatus main assembly; in other words, electrical connection is established between the charging means 2, auxiliary charging means 7 and 6, development sleeve 41 of the developing means 4 of the cartridge 8, and the bias voltage application power sources 20, 21, 22, and 23 of the apparatus main assembly, respectively.

Designated by a reference numeral 5 is a toner replenishment unit (replenishment developer container) for replenishing the developing means 4 with toner. The toner replenishment unit 15 is removably mountable into the apparatus main assembly so that it is connected to the developing means 4. The mounting of the toner replenishment unit 5 into the apparatus main assembly is guided by a toner replenishment unit guiding means 110*b*.

(2-1) Photosensitive Drum 1

The photosensitive drum 1 in this embodiment is a photosensitive drum made up of organic photoconductor (OPC). More specifically, it is made up of a aluminum cylinder (electrically conductive substrate), and the following three layers coated on the peripheral surface of the aluminum cylinder in the listed order: an under coat layer coated on the peripheral surface of the aluminum cylinder to prevent optical interference and improve the adhesion of the upper layers to the aluminum cylinder, a photoelectric charge generating layer, a charge transfer layer (20 μm in thickness). The photosensitive drum 1 is 30 mm in external diameter, and is rotationally driven about the axial line of its center axle at a process speed (peripheral velocity) of 204 mm/sec in the counterclockwise direction indicated by an arrow mark in the drawing.

(2-2) Charging Means 2

In this embodiment, the charging means 2 is a charge roller as a contact charging device. The photosensitive drum 1 is uniformly charged to the negative polarity by applying to this charge roller 2 a voltage which satisfies preset conditions.

The charge roller 2 is 230 mm in length. It is a three-layer structure; it is made up of a metallic core 2*a* (supporting member), an under layer 2*b* coated around the peripheral surface of The metallic core 2*a*, an intermediary layer 2*c* coated around the under layer, and a surface layer 2*d* coated around the intermediary layer 2*d*. The under layer 2*b* is formed of sponge to minimize the charging noise. The intermediary layer 2*c* is a resistance layer for rendering the entirety of the charge roller 2 uniform in electrical resistance. The surface layer 2*d* is a protective layer provided to prevent electrical leakage even if the photosensitive drum 1 has defects such as pinholes. The charge roller 2 in this embodiment employs a stainless steel rod which is 6 mm in diameter, as the metallic core 2*a*. As the material for the surface layer 2*d*, fluorinated resin, in which carbon particles are dispersed, is used. The overall external diameter of the charge roller 2 is 14 mm, and the overall electrical resistance of the charge roller 2 is in a range of $10^4$ ohm-$10^7$ ohm.

The charge roller 2 is rotatably supported at the lengthwise ends of the metallic core 2*a* by a pair of bearings, one for one, and is kept pressed against the peripheral surface of the photosensitive drum 1 by compression springs which apply a preset amount of pressure upon the lengthwise ends of the metallic core 2*a* toward the photosensitive drum 1. The charge roller 2 is rotated by the rotation of the photosensitive drum 1. To the charge roller 2, a preset oscillatory voltage (charge bias voltage: Vdc+Vac), that is, a combination of DC and AC voltages (having preset frequency), is applied from an electric power source 20, as a voltage applying means, to the charge roller 2 through its metallic core 2*a*. As the charge bias voltage is applied to the charge roller 2, the peripheral surface of the rotating photosensitive drum 1 is uniformly charged to the preset polarity and potential level. The interface between the charge roller 2 and photosensitive drum 1 constitutes the charging station a.

In this embodiment, the charge bias voltage applied to the charge roller 2 is an oscillatory voltage made up of −1,500 V of a DC voltage and an AC voltage which is 1,985 Hz in frequency, 1,400 V in peak-to-peak voltage, and sinusoidal in waveform. With the application of this charge bias to the charge roller 2 which is in contact with the peripheral surface of the photosensitive drum 1, the peripheral surface of the photosensitive drum 1 is uniformly charged to −500 V (potential level Vd of unexposed point).

The charging means is provided with a charge roller cleaning means 2*f*, which is in contact with the charge roller 2. In this embodiment, the cleaning means 2*f* is in the form of a piece of flexible film. The cleaning film 2*f* is disposed in parallel with the lengthwise direction of the charge roller 2. The cleaning film 2*f* is attached to a supporting member 2*g*, by one of the edges which are parallel with the charge roller 2. The supporting member 2*g* is reciprocally movable by a preset distance in the direction parallel with the lengthwise direction of the charge roller 2. Further, the cleaning film 2*f* is disposed so that the portion of the cleaning film 2*f*, which is next to the other edge parallel with the charge roller 2, is placed in contact with the charge roller 2 to form a contact nip. A supporting member 2*g* is driven by a motor of the image forming apparatus 100 through a gear train, being thereby reciprocally moved the preset distance in the lengthwise direction. As a result, the surface layer 2*d* of the charge roller 2 is rubbed by the cleaning film 2*f*, causing the adherent contaminants (microscopic toner particles, and external additives, etc.) on the surface layer 2*d* of the charge roller 2 to be removed.

(2-3) Exposing Means 3

The exposing means 3 is a system which scans the peripheral surface of the photosensitive drum 1 with a beam of laser light which it projects while modulating it with sequential digital electrical signals, which are in accordance with the color components into which a color original has been separated.

In this embodiment, a laser beam scanner made up of a semiconductor laser is employed as the exposing means 3. The laser beam scanner 3 scans the uniformly charged peripheral surface of the rotating photosensitive drum, with a beam L of laser light which it outputs while modulating it with video signals sent to the image forming apparatus 100 from the host apparatus 150 such as an image reading apparatus. As the uniformly charged peripheral surface of the photosensitive drum 1 is scanned as described above, the numerous exposed points of the surface reduces in potential, effecting thereby an electrostatic latent image on the peripheral surface of the rotating photosensitive drum 1. The electrostatic latent image is in accordance with the image information with which the beam L of laser light was modulated. In this embodiment, the potential level of exposed point (V1) is −150 V. The exposure station b is where the beam L of exposure light (laser beam) is focused on the uniformly charged area of the peripheral surface of the photosensitive drum 1.

(2-4) Developing Means 4

In this embodiment, the developing means 4 is a contact developing device which uses two-component developer (developing device of magnetic brush type, which uses two-component developer).

This developing device 4 has a developing means housing 40 (developing means container), a development sleeve 41 as a developer bearing member, and a developer regulating blade 42 as a developer regulating member. The development sleeve 41 has a magnetic roll, which is stationarily disposed in the hollow of development sleeve 41. In the developing means housing 40, two-component developer 46, which essentially is a mixture between resinous toner particles (toner) and magnetic carrier particles (carrier), is stored. The developing means housing 40 is provided with a pair of stirring screws 43 and 44 as developer stirring members, which are disposed on the bottom side of the internal space of the housing 40.

The development sleeve 41 is disposed in the developing means housing 40 so that the peripheral surface portion of the development sleeve 41 is partially exposed from the developing means housing 40. The above-mentioned developer regulating blade 42 is disposed so that a preset amount of gap is provided between the blade 42 and the peripheral surface of the development sleeve 41. As the development sleeve 41 is rotated in the direction indicated by an arrow mark in the drawing, the developer regulating blade 42 forms a thin layer of developer on the peripheral surface of the development sleeve 41.

The development sleeve 41 in this embodiment is disposed close to the photosensitive drum 1 in a manner to oppose the photosensitive drum 1 so that the shortest distance (S-Dgap) between the development sleeve 41 and photosensitive drum 1 is kept at 350 μm. Where the photosensitive drum 1 opposes the development sleeve 41 is the development station c.

The development sleeve 41 is rotationally driven so that the direction in which the peripheral surface of the development sleeve 41 moves in the development station c is opposite to the direction in which the peripheral surface of the photosensitive drum 1 advances in the development station c.

To the development sleeve 41, a preset development bias voltage is applied from an electric power source 23 as a voltage applying means. In this embodiment, the development bias voltage applied to the development sleeve 41 is an oscillatory voltage, which is a combination of DC voltage (Vdc) and AC voltage (Vac). More specifically, it is the combination of −350 V of DC voltage, and an AC voltage which is 1,800 in peak-to-peak voltage and 2,300 Hz in frequency.

Thus, as the development sleeve 41 is rotated, the developer 46 is coated in a thin layer onto the peripheral surface of the rotating development sleeve 41, and conveyed to the development station c by the rotation of the development sleeve 41. In the development station c, the toner in the developer 46 is adhered to the numerous exposed points of the peripheral surface of the photosensitive drum 1, which effects the electrostatic latent image, by the electric field generated by the development bias voltage. As a result, the electrostatic latent image is developed into an image formed of toner (toner image). In this embodiment, toner is adhered to the exposed points of the peripheral surface of the photosensitive drum 1; in other words, the electrostatic latent image is developed in reverse. The portion of the thin layer of the developer 46 on the peripheral surface of the development sleeve 41, which has passed the development station c, is returned by the subsequent rotation of the development sleeve 41 to a developer reserve space in the developing means housing 40.

The stirring screws 43 and 44 in the developing device 4 rotate in synchronization with the rotation of the development sleeve 41. They have the function of charging toner to a preset polarity and potential level by stirring and mixing the toner as the toner is supplied into the developing means housing 40 from the toner replenishment unit 5. The stirring screws 43 and 44 are opposite in the direction in which they convey the developer 46 in their lengthwise direction. They have the function of supplying the development sleeve 41 with the developer 46. Further, the stirring screws 43 and 44 have the function of conveying the portion of the developer 46, which has been reduced in toner density (toner ratio of developer) by the development process, to the toner replenishment area; they have the function of circulating the developer 46 in the developing means housing 40.

The developing device 4 is provided with a sensor 45 for determining the toner density of the developer 46 by detecting the changes in the permeability of the developer 46. The sensor 45 is attached to the wall of the developing means housing 40, which is on the stirring screw 44 side, and on the upstream side of the stirring screw 44 in terms of the direction in which the developer 46 is circulated. The developing device 4 is also provided with a toner replenishment hole 47, which is on the slightly downstream side of the sensor 45. After being subjected to the developing operation, the developer 46 is carried to the area where the sensor 45 is present. In this area, the toner density is detected. In response to the result of this detection, a screw 51 with which the toner replenishment unit 5 connected to the developing device 4 is rotated, as necessary, to keep constant the toner density of the developer 46. As the screw 51 is rotated, toner is supplied from the toner replenishment unit 5 into the developing device 4 through the toner replenishment hole 47 of the developing device 4. After being supplied to the developing device 4, the toner is conveyed by the stirring screw 44, while being mixed with the carrier. As a result, the toner is given a proper amount of electric charge. Then, the toner (developer 46) is carried to the adjacencies of the development sleeve 41. Then, the developer 46 is borne on the development sleeve 41, and is formed into a thin layer of developer, on the development sleeve 41, to be used for development.

In this embodiment, negatively chargeable toner which is 5.5 μm in average particle diameter is used. As the carrier, magnetic carrier which is 205 emu/cm$^3$ in saturation magnetization and 35 μm in average particle diameter, is used. The normal polarity of the toner used in this embodiment is negative. Further, the mixing ratio between the toner and carrier in the developer used in this embodiment is 6:94 in weight ratio. The amount of electric charge which the toner had after being adhered to the peripheral surface of the photosensitive drum 1 was −25 μC/g.

(2-5) Auxiliary Charging Means 7 and 6

The auxiliary charging means 7 and 6 are disposed downstream of the primary transfer station d and upstream of the charging station a, in terms of the rotational direction of the photosensitive drum 1. They are disposed in contact with the photosensitive drum 1, with the auxiliary charging means 7 being on the upstream side of the auxiliary charging means 6. They are the residual toner diffusing means and toner charge amount controlling means, respectively.

In this embodiment, both the toner charge amount controlling means 6 and residual toner diffusing means 7 are brushing members made up of electrically conductive fibers. Referring to FIG. 2, designated by a reference character e is where the residual toner diffusing means 7 is in contact with the photosensitive drum 1, and designated by a reference character f is where the toner charge amount controlling means 6 is in contact with the photosensitive drum 1. To the residual toner diffusing means 7 and toner charge amount controlling means 6, preset voltages are applied from electric power sources 22 and 21, respectively.

The brush portion 61 of the toner charge amount controlling means 6 and the brush portion 71 of the residual toner diffusing means 7 are formed of rayon, acrylic, or polyester fiber, or the like, in which metallic powder has been dispersed to control their electrical resistance. In order to ensure that the brush portions 61 and 71 evenly contact the peripheral surface of the photosensitive drum 1 and the transfer residual toner thereon, they are desired to be no more than 30 denier in thickness, and 10,000-500,000 strand/inch$^2$ in density. In this embodiment, the brush portions 61 and 71 are both 6 denier in thickness, 100,000 strand/inch$^2$ in density, 5 mm in length, and $6\times10^3$ ohm.cm in volume resistivity. Further, the toner charge amount controlling means 6 and residual toner diffusing means 7 are placed in contact with the peripheral surface of the photosensitive drum 1 so that the amount of apparent invasion of the brush portions 61 and 71 into the peripheral surface of the photosensitive drum 1 is 1 mm. The width of the contact nip between the brush portion 61 and photosensitive drum 1 and the width of the contact nip between the brush portion 71 and photosensitive drum 1 are both 5 mm.

The transfer residual toner, that is, the toner remaining on the peripheral surface of the photosensitive drum 1 after the transfer (primary transfer) of the toner image from the photosensitive drum 1 onto the intermediary transfer belt 91, contains negatively charged toner particles (normally charged toner particles), that is, those which have adhered to the exposed points of the peripheral surface of the photosensitive drum 1, and positively charged toner particles (reversely charged toner particles), that is, those which have adhered to the unexposed points of the peripheral surface of the photosensitive drum 1. Further, the residual toner also contains the toner particles which have been changed (reversed) in polarity from negative to positive by the positive voltage applied during the transferring process.

In this embodiment, the transfer residual toner, which is the mixture of the positively charged toner particles and reversely charged toner particles, is diffused by the residual toner diffusing means 7 to erase the remnant of the transferred toner image, which is on the photosensitive drum 1. To achieve this objective, conditions are set for the voltage to be applied to the residual toner diffusing means 7 from the electric power source 22. In this embodiment, an AC voltage, which is a combination of DC and AC voltages, is applied to the residual toner diffusing means 7 by the power source 22 during image formation. The application of the AC voltage to the residual toner diffusing means 7 electrostatically improves the residual toner diffusing means 7 in its ability to erase the remnant of the transferred toner image on the photosensitive drum 1. Further, the application of the DC voltage (which is applied as the part of the abovementioned AC voltage applied to the residual toner diffusing means 7) to the residual toner diffusing means 7 removes electric charges from the numerous points of the peripheral surface of the photosensitive drum 1, which are effecting the residual electrostatic latent image, preventing thereby the formation of images suffering from positive ghosts.

Further, to the toner charge amount controlling means 6, negative voltage, that is, voltage, the polarity of which is the same as that of the normally charged toner, is applied from an electric power source 21. The application of this voltage is for preventing the charge roller 2 from contaminated by the small amount of the residual toner which slips by the residual toner diffusing means 7. In this embodiment, no less than −700 V of DC voltage, which is greater in absolute value than the electrical discharge start voltage, is applied to the toner charge amount controlling means 6. This application of the DC voltage to the toner charge amount controlling means 6 causes the small amount of residual toner having reached the toner charge amount controlling means 6 to be negatively (normally) charged by an ample amount of electrical discharge. In other words, while the residual toner passes the toner charge amount controlling means 6, it is rendered uniform in polarity; all the residual toner particles become negatively charged. Thereafter, the peripheral surface of the photosensitive drum 1 is charged, with the transfer residual toner having passed the toner charge amount controlling means 6 remaining on the peripheral surface of the photosensitive drum 1. In this case, all the residual toner particles having passed the toner charge amount controlling means 6 have been negatively charged by the toner charge amount controlling means 6. Therefore, these toner particles do not adhere to the charge roller 2. Moreover, the electric charge of the transfer residual toner is removed, by a proper amount, by the AC bias applied to the charge roller 2.

Next, the peripheral surface of the photosensitive drum 1 is exposed, with the transfer residual toner remaining on the peripheral surface of the photosensitive drum 1, during the exposing process carried out in the exposure station b. However, the amount of the residual toner on the peripheral surface of the photosensitive drum 1 is very small. Therefore, the effect of the presence of the residual toner on the peripheral surface of the photosensitive drum 1 does not manifest.

Then, the transfer residual toner on the peripheral surface of the photosensitive drum 1 is removed in the development station c while the development process is carried out; the peripheral surface of the photosensitive drum 1 is cleaned while the development process is carried out. More specifically, all the transfer residual toner particles having adhered to the unexposed points (non-image points) of the peripheral surface of the photosensitive drum 1, that is, the points of the peripheral surface of the photosensitive drum 1, which are not to be developed, are those which have been electrically discharged by a proper amount by the charge roller 2 after being negatively charged. Therefore, the mirror force between them and the photosensitive drum 1 has been reduced, ensuring that the residual toner particles having adhered to the unexposed points of the peripheral surface of the photosensitive drum 1 are completely collected into the developing device 4 by the relationship (potential difference Vback: potential difference for fog prevention) between the abovementioned surface potential level of the photosensitive drum 1 and the DC component (−350 V) of the development bias. In this embodiment, the development sleeve 41 of the developing device 4 is rotated in such direction that the movement of its peripheral surface in the development station c is opposite to the direction in which the peripheral surface of the photosensitive drum 1 advances in the development station c, and also, that the developer layer on the peripheral surface of the development sleeve 41 rubs the peripheral surface of the photosensitive drum 1. This arrangement is advantageous from the standpoint of the collection of the transfer residual toner on the photosensitive drum 1.

(3) Fourth Image Formation Station PBk

Referring to FIG. 1, the fourth image formation station PBk is an electrophotographic image formation system provided with the cleaning apparatus 109. The normal polarity to which the toner used by the fourth image formation station PBk is negative, and the polarity of the primary transfer voltage is positive.

The photosensitive drum 1 is rotationally driven about the axial line of its supporting shaft in the counterclockwise direction indicated by an arrow mark R1 in the drawing, at a process speed (peripheral velocity) of 204 mm/sec, which is the same as that at which the photosensitive drums 1 of the first-third image formation stations PY, PM, and PC are rotationally driven.

The peripheral surface of the rotating photosensitive drum 1 is exposed in its entirety by a pre-exposing apparatus 102, being thereby discharged. Then, it is uniformly charged by the charging means 2 to preset polarity and potential level. As the charging means 2, a corona discharging means is employed. In this embodiment, the peripheral surface of the photosensitive drum 1 is uniformly charged to +400 V (surface potential level Vd: potential level of unexposed point). The uniformly charged peripheral surface of the photosensitive drum 1 is exposed by the exposing means 3. In this embodiment, a laser beam scanner made up of a semiconductor laser is employed as the exposing means 3. As the peripheral surface of the photosensitive drum 1 is exposed to the scanning beam L of laser light projected from the exposing means 3, an electrostatic latent image which corresponds to an intended image is formed on the peripheral surface of the photosensitive drum 1. In this embodiment, the peripheral surface of the photosensitive drum 1 is exposed to the scanning exposure beam L emitted by the semiconductor laser, which is 680 μm in wavelength, while being modulated in pulse width (PWM), so that an electrostatic latent image is formed on the peripheral surface of the photosensitive drum 1 at a resolution of 600 dpi. The exposing means 3 (semiconductor laser) is adjusted so that the potential level V1 of an exposed point of the electrostatic latent image is +50 V. The electrostatic latent image is developed by the developing means 4 into a visible image, that is, a toner image (image formed of toner). The toner image is transferred onto the belt 91 in the primary transfer station d, as described above. The transfer residual toner, that is, the toner which remained on the peripheral surface of the photosensitive drum 1 (which was not transferred onto belt 91) is removed by the cleaning blade 109*b* of the cleaning apparatus 109. The fourth image formation station PBk is disposed, as a built-in image formation unit, in the apparatus main assembly. It is not in the form of a process cartridge.

(3-1) Photosensitive Drum 1

As the photosensitive drum 1 in the fourth image formation station PBk, an electrophotographic photosensitive member is employed. It is made up of an electrically conductive substrate which is in the form of a drum, and a photo-receptive layer formed on the peripheral surface of the substrate. The photo-receptive layer is made up of multiple sub-layers, which are a charge injection preventing under-layer formed of amorphous silicon, a photoconductive layer formed of amorphous silicon hydride, and a surface layer formed of amorphous silicon carbide, listed from the electrically conductive substrate side. The surface layer has a free face. Further, the photoconductive layer is made of first and second layers (listed from electrically conductive substrate side), which are different in function. In order to prevent the interfacial reflection, it is desired that the transition between the photoconductive layer and surface layer is continuous. Further, if necessary, the photoconductive layer may be formed of amorphous silicon doped with halogen atoms. Further, the surface layer may be formed of a material other than silicon carbide, for example, amorphous silicon nitride and amorphous carbon.

In this embodiment, the above-mentioned photosensitive drum 1 is made up of an aluminum cylinder 1*a* (FIGS. 3 and 4), which is 108 mm in diameter and roughly 5 mm in wall thickness, and a 30 μm thick photosensitive layer 1*b* formed on the peripheral surface of the aluminum cylinder, of amorphous silicon, by glow discharge or the like. In other words, the photosensitive drum 1 has a surface layer formed of amorphous silicon. In the hollow of the photosensitive drum 1, a cylindrical heater 114, which is roughly 80 W in output, is disposed. The electric power supplied to the heater 114 is controlled so that the temperature of the aluminum cylinder remains at 42° C. The choice of a photosensitive drum with which the present invention is compatible is not limited to a photosensitive drum made up of amorphous silicon.

(3-2) Developing Means 4

Figure 3:
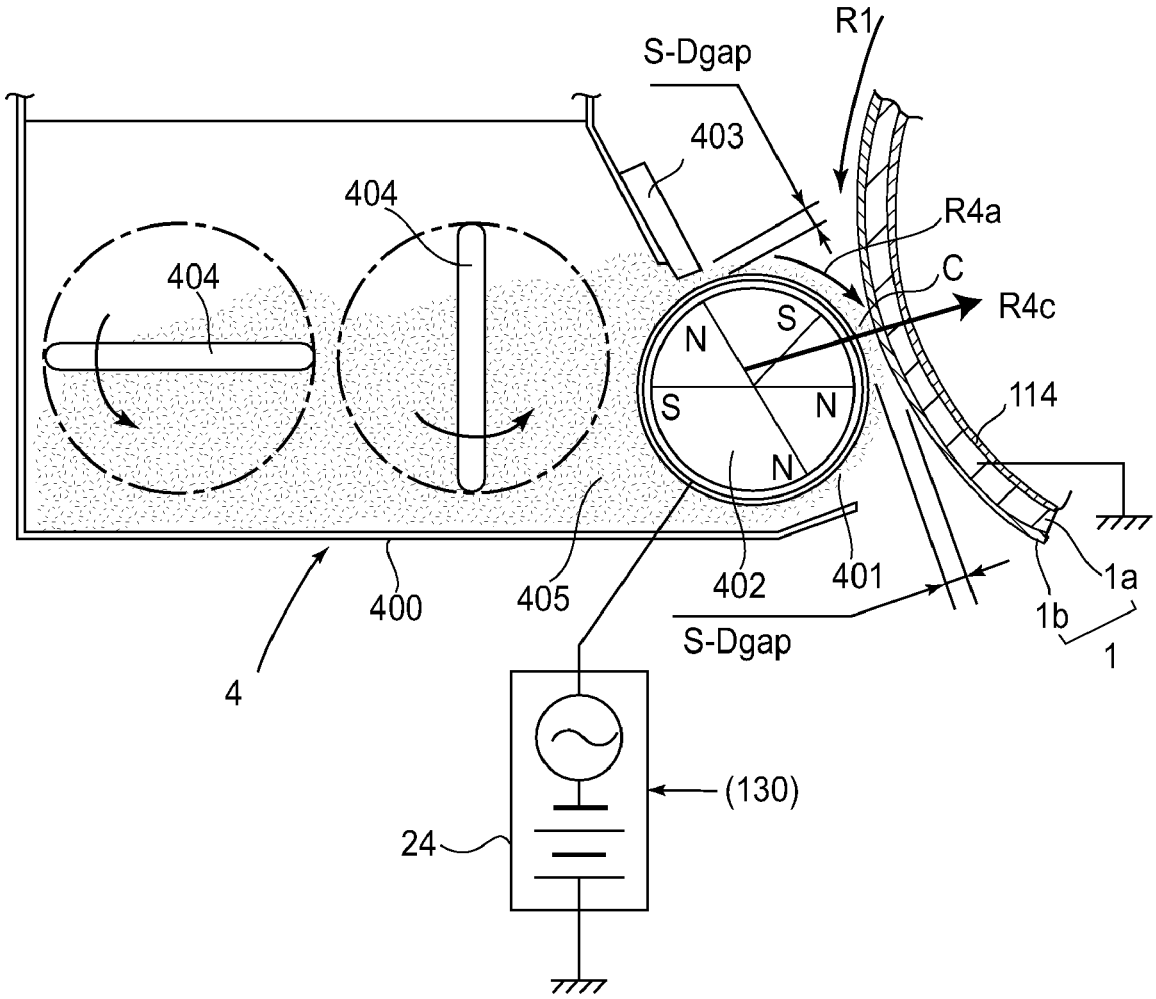
FIG. 3 is a schematic sectional drawing showing the structure of the developing apparatus (which uses single-component developer) of the image formation station having no cleaning system.

FIG. 3 is an enlarged schematic view of the developing means portion of the image forming apparatus. In this embodiment, the developing means 4 is a developing device which uses single-component magnetic developer. That is, the developer used by this developing means 4 is magnetic toner, that is, toner whose particles themselves contain a magnetic substance. The polarity to which the toner is normally charged is negative.

A developing means housing 400 has an opening which extends in the lengthwise direction of the apparatus. A development sleeve 401, as a developer bearing member, is disposed in this opening. The development sleeve 401 is made of a material such as aluminum or SUS. Referring to the drawing, the development sleeve 401 is disposed so that roughly the left half of the development sleeve 401 is inside the developing means housing 400, and roughly the right half is exposed from the developing means housing 400. Further, the development sleeve 401 is disposed so that it opposes the photosensitive drum 1 through the opening, and it is rotatable. There is provided a minute gap S-Dgap between the development sleeve 401 and photosensitive drum 1. The development sleeve 401 is rotationally driven in the direction indicated by an arrow mark R4*a*, whereas the photosensitive drum 1 is rotationally driven in the direction indicated by an arrow mark R1. This minute gap S-Dgap can be changed in size; the developing means housing 400 can be moved relative to the development sleeve 401 by a moving means (unshown) in the direction indicated by an arrow mark R4*c* to change the minute gap S-Dgap in size.

Within the hollow of the development sleeve 401, a magnet 402 is disposed as a magnetic field generating means. In this embodiment, the magnet 402 is a permanent magnet. This magnet 402 is non-rotationally disposed in the hollow of the development sleeve 401 so that a stationary magnetic field is generated regardless of the rotation of the development sleeve 401.

In the adjacencies of the development sleeve 401 in the developing means housing 400, a magnetic blade 403, as a developer regulating member, is disposed, which is in the formed of a piece of a plate. The magnetic blade 403 is attached to the developing means housing 400, with one of the edge portions parallel with the development sleeve 401 supported by the edge portion of the opening of the developing means housing 400 and the opposing edge portion placed close to the development sleeve 401. The magnetic blade 403 and magnet 402 are positioned so that one of the magnetic poles of the magnet 402 roughly opposes the magnetic blade 403.

Magnetic toner 405 is borne on the development sleeve 401 by a stirring member 404. Then, the magnetic toner 405 on the development sleeve 401 is conveyed by the subsequent rotation of the development sleeve 401 to the area in which the magnetic blade 403 opposes the development sleeve 401. Then, the layer of the magnetic toner 405 on the development sleeve 401 is regulated in thickness by the magnetical regulating means, that is the gap S-Bgap between the magnetic blade 403 and development sleeve 401, forming therefore a thin layer of magnetic toner 405 on the peripheral surface of the development sleeve 401. After coming out of the toner regulating portion S-Bgap, this thin layer of magnetic toner 405 is conveyed to the development area c in which the development sleeve 401 (magnetic toner layer) opposes the photosensitive drum 1, with the presence of the minute gap S-Dgap between the development sleeve 401 and photosensitive drum 1.

In the development area c, an electric power source 24, as a bias applying means, applies oscillatory voltage, as development bias, which is a combination of DC and AC voltages, between the development sleeve 401 and photosensitive drum 1. As a result, the toner 405 on the development sleeve 401 transfers onto the electrostatic latent image on the photosensitive drum 1, and adheres to the electrostatic latent image; in other words, the toner 405 develops the electrostatic latent image into a visible image, that is, an image formed of the toner 405.

Next, the development by the above-mentioned developing device 4 will be described. As described above, the peripheral surface of the photosensitive drum 1 is uniformly charged to a potential level of +400 V (drum surface potential level). Then, the peripheral surface of the photosensitive drum 1 is exposed, at a resolution of 600 dpi, to the scanning beam L emitted, while being modulated in pulse width (PWM), from a semiconductor laser, which is 680 μm in wavelength. As a result, an electrostatic latent image is effected on the photosensitive drum 1. The power of the laser is set so that as a given point of the uniformly charged area of the peripheral surface of the photosensitive drum 1 is exposed, its potential reduces to +50 V (V1). The electrostatic latent image is developed by the developing device 4, which is 250 μm in S-Bgap and 250 μm in S-Dgap, into a visible image, that is, an image formed of the toner 405. In the preceding section of this specification, a conventional color image forming process in which a latent image is normally developed was described. In this embodiment, however, the developing method in which a latent image is reversely developed is used. This method will be described next.

The developer used in this embodiment is magnetic single-component negative toner. The development bias is a combination of DC and AC voltages. The DC voltage is +200 V, and the AC voltage is 2,700 Hz in frequency, 1,500 V in peak-to-peak voltage, and 50% in duty. The developing method is the jumping developing method. This setup is used to achieve 200 V of development contrast Vcont (=Vd−Vdc) and +150 V of fog prevention bias Vback (=Vdc−V1).

(3-3) Cleaning Apparatus 109

Figure 4:
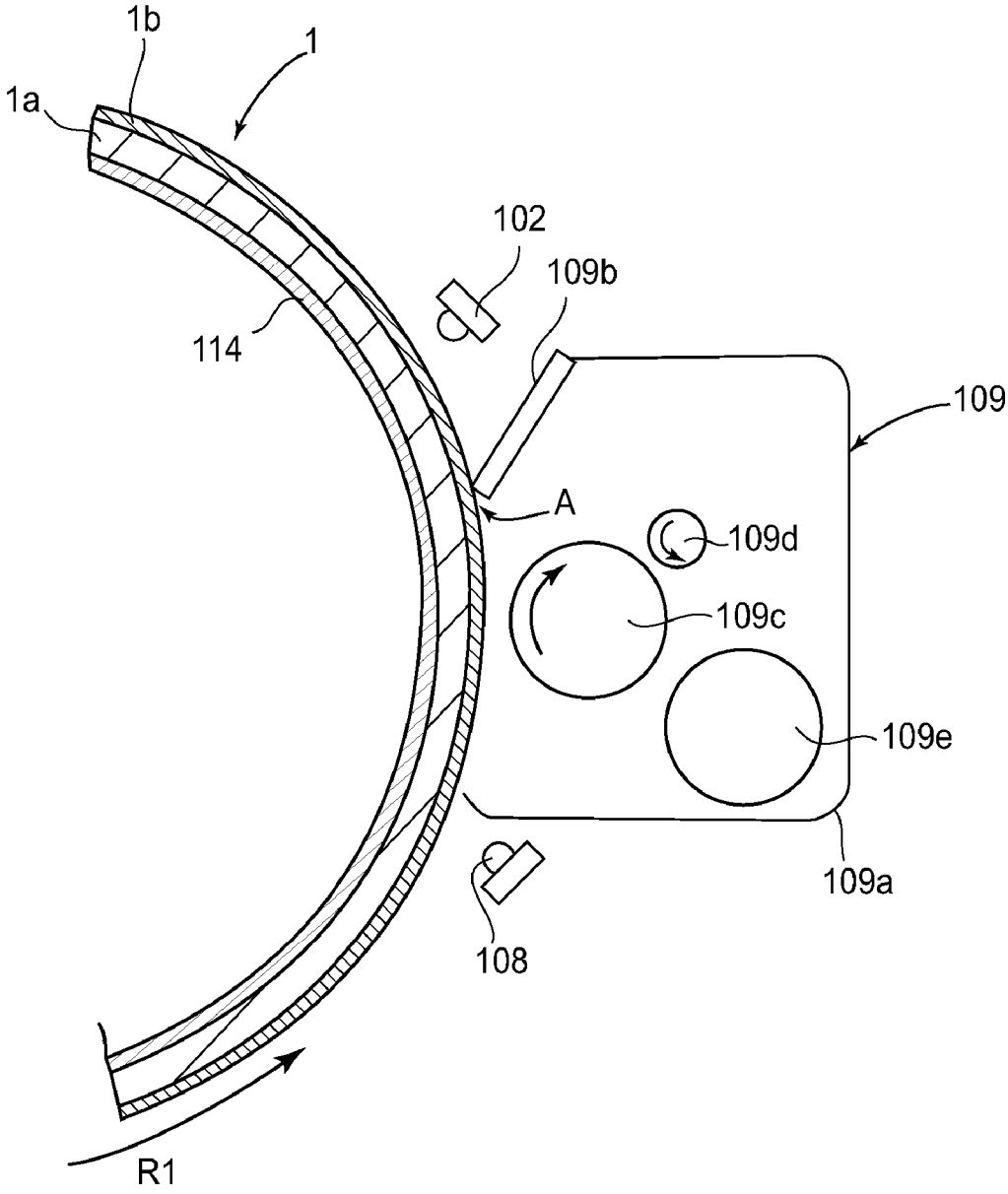
FIG. 4 is a schematic drawing showing the structure of the cleaning apparatus of the image formation station having the cleaning apparatus.

FIG. 4 is an enlarged schematic drawing of the cleaning apparatus portion of the image forming apparatus. In this embodiment, the cleaning apparatus 109 is a cleaning apparatus of the counter-blade type.

The cleaning apparatus 109 has a cleaning means housing 109*a*, and a cleaning blade 109*b*. The cleaning blade 109*b* is held to the housing 109*a*, and is in contact with the peripheral surface of the photosensitive drum 1. The cleaning apparatus 109 also has a magnetic roller 109*c*, a regulating roller 109*d*, and a screw 109*e*, which are located on the upstream side of the cleaning blade 109*b* (in terms of rotational direction of photosensitive drum 1). The magnetic roller 109*c*, as a magnetic roll, is positioned so that a preset amount of gap is provided between the magnetic roller 109*c* and photosensitive drum 1.

The magnetic roller 109*c* is a member for rubbing the substances having adhered to the photosensitive drum 1. The magnetic roller 109*c* is coated with the magnetic toner by adhering the magnetic toner to the magnetic roller 109*c*, and the photosensitive drum 1 is rubbed by the magnetic brush. The regulating roller 109*d* is a member for regulating the amount by which the magnetic toner is allowed to remain coated on the magnetic roller 109*c* after being adhered to the magnetic roller 109*c*. If the amount is not regulated, the photosensitive drum 1 is excessively rubbed, which is problematic in that the photosensitive drum 1 is shaved.

Incidentally, on the upstream side of the cleaning apparatus 109, in terms of the rotational direction of the photosensitive drum 1, a pre-cleaning exposing apparatus 108 is disposed.

The cleaning blade 109*b* is 3 mm in thickness, and is formed of urethane rubber. The magnetic roller 109*c* is a 18 mm in diameter, and has eight magnetic poles which are 1,000 gauss in magnetic flux density.

The cleaning blade 109*b* is an elastic blade formed primarily of urethane. It is 70° in hardness (Hs), 15 (kg/cm$^2$) 300-200 (%) (JIS). Further, it is 24° in angle of contact and 10 (g/cm) in contact pressure. It is tilted so that its edge A is located upstream of its base (cleaning method of counter-blade type). The cleaning blade 109*b* cleans the peripheral surface of the photosensitive drum 1; it removes the residual toner on the peripheral surface of the photosensitive drum 1 by wiping the peripheral surface of the photosensitive drum 1.

The magnetic roller 109*c* is rotated in such direction that the direction in which its peripheral surface moves in the adjacencies of the photosensitive drum 1 is the same as the direction in which the peripheral surface of the photosensitive drum 1 moves in the adjacencies of the magnetic roller 109*c*. It is rotated at such a peripheral velocity that is 10% of the peripheral velocity of the photosensitive drum 1. It is disposed so that 1.0 mm of gap is provided between the magnetic roller 109*c* and photosensitive drum 1. The regulating roller 109*d* is disposed so that 1.8 mm of gap is provided between the regulating roller 109*d* and photosensitive member 1. It is rotated in such direction that the direction in which its peripheral surface moves in the adjacencies of the photosensitive drum 1 is the same as the direction in which the peripheral surface of the photosensitive drum 1 moves in the adjacencies of the regulating roller 109*d*. It is rotated at such a peripheral velocity that is 10% of the peripheral velocity of the photosensitive drum 1.

(4) Toner Expulsion-and-Collection Control Mode

The voltage applied to the residual toner diffusing means 7 in each of the first-third cleaner-less image formation stations PY, PM, and PC, and the voltage applied to the toner charge amount controlling means 6 in each of the first-third cleaner-less image formation stations PY, PM, and PC, are rendered different in polarity. Therefore, there are cases in which toner particles which are opposite in polarity to the applied voltage continuously accumulate in the auxiliary charging means.

Thus, the control circuit 130 executes a collection control (collection mode), in which it causes the auxiliary charging means 7 and 6 to expel the toner having accumulated therein, onto the no image formation area of the photosensitive drum 1 with a preset timing; the excelled toner is transferred onto the intermediary transferring member; and the expelled toner on the intermediary transferring member is collected in the cleaning station of the fourth image formation station PBk. This collection control comprises the process of expelling toner and the process of collecting the expelled toner.

In the toner expelling process, a preliminary operation is carried out, in which the voltage to be applied to the charge roller 2 from the power source 20 is switched from the combination of DC and AC voltages to an AC voltage alone to reduce the surface potential of the photosensitive drum 1 to roughly 0 V, to make it possible to roughly simultaneously cause the residual toner diffusing means 7 and toner charge amount controlling means 6 to expel the toner. Then, the voltages applied to the residual toner diffusing means 7 and toner charge amount controlling means 6 from the power sources 21 and 22, respectively, are controlled so that toner is expelled from them. These voltages for expelling the toner are set to a value which is in the range (which is ñ300 V) in which the surface potential of the photosensitive drum 1 (which is roughly 0 V) is not affected. During this process, the potential level of the voltage applied to the charge roller 2 is set to such a value that after the expelling of the toner onto the peripheral surface of the photosensitive drum 1, the difference in potential between the peripheral surface of the photosensitive drum 1 and the charge roller 2, will be roughly 0 V. Therefore, the expelled toner, which is a mixture of the normally charged toner particles and reversely charged toner particles, can be moved through the charging station a without allowing the excelled toner to adhere to the charge roller 2. In other words, it is possible to prevent the charge roller 2 from being contaminated by the expelled toner, preventing thereby the formation of defective images, the defects of which are attributable to the contamination of the charge roller 2 by the expelled toner.

Incidentally, in order to prevent the potential of the peripheral surface of the photosensitive drum 1, which is roughly 0 V, from being affected by the process of expelling the toner, the voltages applied to the residual toner diffusing means 7 and toner charge amount controlling means 6 to expel toner are desired to be no higher than the charge start voltage for an actual image forming operation.

The toner expelled from the residual toner diffusing means 7 and toner charge amount controlling means 6 onto the no image formation area of the photosensitive drum 1 is carried to the development station c by the subsequent rotation of the photosensitive drum 1. Basically, most of the expelled toner is collected by the developing means 4. In this embodiment, most of the expelled toner is electrostatically and physically (rubbed away) collected by the developing device 4, which is of the contact type, uses two-component developer, and is rotated in such that the movement of its peripheral surface in the development station c is opposite to that of the photosensitive member 1.

However, the above-mentioned expelled toner carried to the development station c contains such toner particles that are normally (negatively) charged, but are small in the amount of charge, and such toner particles that remained reversely (positively) charged. These toner particles sometimes fail to be completely collected by the developing device 4; some of them are conveyed to the primary transfer station d by the subsequent rotation of the photosensitive drum 1. Then, they are pressed on the belt 91 by the photosensitive drum 1, being thereby transferred (removed) from the photosensitive drum 1 onto the belt 91 (by the contact pressure, and electrostatic force). The bias applied to the primary transfer roller 92 from the power source 92 during this process may be such bias that is equivalent to the bias which is applied to the primary transfer roller 92 when transferring a toner image from the photosensitive drum 1 onto the belt 91 during an actual image forming operation. Obviously, executing control so that bias that is opposite (negative) in polarity to the bias (normal: positive) applied during an actual image forming operation is applied to the primary transfer roller 92 makes it easier for the positively charge toner particles on the photosensitive drum 1 to transfer onto the belt 91, being therefore more effective.

The process of transferring the toner from the peripheral surface of the photosensitive drum 1 onto the belt 91 is carried out with the same timing as the timing with which the no image formation area of the belt 91, that is, the development belt area other than the area across which an image is formed, reaches the primary transfer station d of the image formation station, in which the toner is to be expelled.

The process of expelling the toner from the auxiliary charging means 7 and 6 in each of the cleaner-less image forming stations is carried out with the following timing. That is, it is carried out with such a timing that when the no image formation area of the belt 91, that is, the belt area other than the belt area across which an image is formed by the primary transfer, reaches the primary transfer station, the toner expelled onto the no image formation area of the photosensitive drum 1 can be transferred onto the belt 91.

The expelled toner transferred onto the no image formation area of the belt 9 is carried by the movement of the belt 19 to the image formation station, which is located downstream. Then, it is collected onto the photosensitive drum 1 of the fourth image formation station PBk having the cleaning apparatus 109, in the primary station d of this image formation station d. After being collected onto this photosensitive drum 1, the toner is removed from this photosensitive drum 1 by the cleaning apparatus 109.

In this embodiment, the toner transferred onto the belt is negative in polarity. Incidentally, not only is the toner electrostatically transferred onto the belt, but also, it transfers onto the belt by being pressed upon the belt. Therefore, even if the toner is positive in polarity and the transfer bias is positive in polarity, it is transferable onto the belt. The normal bias for the fourth image formation station PBk is positive, and the reverse bias for the fourth image formation station PBk is negative. Most of the toner particles in the toner having been transferred from the photosensitive drum onto the belt are normal (negative) in polarity. Of course, the apparatus may be designed so that in order to improve the apparatus in the efficiency with which the positively charged toner is expelled, negative bias is applied.

Next, the toner collection process will be described. Most of the toner particles transferred from the cleaner-less image formation stations PY, PM, and PC onto belt 91 are normal in polarity. Thus, for the purpose of collecting them onto the photosensitive drum 1 of the image formation station PBk, in the primary transfer station d of the image formation station PBk having the cleaning apparatus 109, the bias applied to the primary transfer roller 92 of the image formation station PBk is desired to be rendered opposite in polarity to the normal bias applied during an actual image forming operation. Further, the amount of the expelled toner is not very much. Therefore, the reverse bias to be applied does not need to be set to a very large value.

Further, reversing polarity increases the cost of a power source 93, adding thereby to the initial cost of the apparatus. As the methods for eliminating this requirement of applying reverse bias, there are methods for collecting the toner onto the photosensitive drum 1 with the use of only the normal bias. For example, there is a method in which in order to reverse the toner in polarity, such bias that is the same in polarity as the normal transfer bias and higher in potential than the bias applied for an actual image forming operation, is used. This method is lower in toner collection efficiency than the above-mentioned method in which reverse bias is applied, but is advantageous from the standpoint of initial cost. In this embodiment, however, the expelled toner on the belt 9 is collected onto the photosensitive drum 1 by applying to the primary transfer roller 92 the bias which is opposite in polarity to the above-mentioned normal transfer bias.

As described above, toner is expelled from the auxiliary charging means 7 and 6 onto the photosensitive drum 1 in each of the first-third cleaner-less image formation stations PY, PM, and PC, and then, is transferred from the photosensitive drum 1 onto the belt 91. Then, the transferred expelled toner on the belt 91 is collected onto the photosensitive drum 1 of the fourth image formation station PBk having the cleaning apparatus 109, and is removed by the cleaning apparatus 109 of this image formation station PBk.

The employment of the above-described structural arrangement makes it unnecessary for the expelled toner to be collected by the cleaning station for cleaning the intermediary transferring member. Therefore, it can reduce the length of time for the toner expulsion mode. Further, it prevents the problem that because the portion of the surface of the belt 91, which has been contaminated by the expelled toner, is moved into the secondary transfer station by the circular movement of the belt 91, the secondary transfer roller 10 is contaminated by toner. Therefore, control does not need to be executed to separate the secondary roller 10 from the belt 91.

Further, even when the fourth image formation station PBk having the cleaning apparatus 109 is low in average image printing ratio, the lubricity between the photosensitive drum 1 and cleaning blade 109*b* is maintained by the above-mentioned collection of the expelled toner. Therefore, it is possible to prevent the occurrence of the problem that the cleaning blade109*b* is dragged into the interface between itself and photosensitive drum 1, or is caused to vibrate.

In this embodiment, the image forming apparatus is structured so that the toner in the residual toner diffusion controlling means 7 and toner charge amount controlling means 6 is expelled onto the intermediary transferring member. However, this preferred embodiment is also applicable to a case in which the unnecessary toner particles in the developing means, for example, the reversal toner particles, that is, the charged toner particles which are opposite in polarity to the normally charged toner particles, and the toner particles which are low in the amount of electric charge, are expelled. Such application yields the same effects as those described above.

As described above, this preferred embodiment makes it unnecessary for the expelled toner to be collected by the cleaning means for cleaning the intermediary transferring member, making it possible to substantially reduce the length of time for the expulsion-and-collection mode.

Further, according to this embodiment, the expelled toner is collected in the image formation station having the cleaning apparatus which employs the counter cleaning blade. In other words, the cleaning blade is provided with the expelled toner, which functions as a lubricant, being thereby prevented from being dragged into the interface between it and photosensitive member, or from vibrating.

This embodiment of the present invention can substantially reduce the amount of fresh supply of toner necessary to lubricate the cleaning blade, being therefore very effective from the standpoint of cost and productivity.

In order to masterfully use an image bearing member, such as a photosensitive drum made up of amorphous silicon, which is extremely small in the amount of frictional wear, and therefore, thought to be very important from the standpoint of longevity, it is necessary to provide a cleaning system capable of reliably cleaning an image bearing member such as the above-mentioned one. According to the present invention, even if a photosensitive drum, such as a photosensitive drum based on amorphous silicon, which is low in the amount of frictional wear, is employed as the image bearing member for an image formation station having a cleaning apparatus, the problem that the cleaning blade is dragged into the interface between the blade and photosensitive drum, the blade vibration problem attributable to lack of lubrication, and the like, can be prevented. In other words, not only does the present invention make it possible to eliminate the need for a cleaning means dedicated to the removal of the transfer residual toner, but also, is effective to eliminate the above described problems.

Incidentally, it is not problematic to carry out at the same time the collection mode in which the expelled toner is collected in the cleaning station for cleaning the downstream photosensitive drum, and the collection mode in which the expelled toner is collected in the cleaning station for cleaning the intermediary transferring member.

Embodiment 2

Printing tests, in which the above-mentioned image forming apparatus is used to print 50,000 copies of the following test image, were carried out in an ambient environment which were normal in both temperature and humidity. More specifically, each of the image formation stations PY, PM, and PC, that is, the cleaner-less image formation stations, of the image forming apparatus described above was used to print 50,000 copies of the following test image. The test image used for the tests was 40% in the actual average image printing ration $\alpha 2$ (per 100 A4 sheets of copy) of the cleaner-less image formation station, and 5% in the actual average image printing ratio $\beta 2$ of the image formation station PBk having the cleaning blade.

The above-mentioned actual average image printing ratios $\alpha 2$ and $\beta 2$ were measured using a video count control system. More specifically, the control circuit 130 has an image density calculating means (video count control system) which detects the image density of each image output, accumulates the calculated image densities, and calculates the average image printing ratio per preset number of sheets of image output.

The printing tests were carried out under the following conditions. That is, the limit value $\alpha 1$ for the average image printing ratio (per 100 A4 sheets of copy) for the cleaner-less image formation station, above which the process of causing the cleaner-less image formation station to expel toner is to be carried out was set to 30%, and the limit value $\beta 1$ for the average image printing ratio (per 100 A4 sheets of copy) for the image formation station PBk having the cleaning blade, above which the process of causing the image formation station PBk having the cleaning blade to collect the expelled toner is to be carried out was set to 10%. The above-mentioned limit values $\alpha 1$ and $\beta 1$ were stored as comparative values in the control circuit 130.

The timing with which the toner was expelled from the auxiliary charging means 7 and 6 of the cleaner-less image formation station is as follows. That is, when the no image formation area of the belt 91, that is, the area of the belt 91 other than the area of the belt 9 across which images are formed by transfer, reaches the primary transfer station d, the toner expelled onto the no image formation area of the photosensitive drum 1 of the same image forming station can be transferred onto the belt 91. The length of the toner expulsion time s was set to 3 seconds.

As the actual average image printing ratio $\alpha 2$ exceeded the limit value $\alpha 1$ for the average image printing ratio, the process of expelling toner from the auxiliary charging means 7 and 6 was carried out every 100 sheets. As a result, the area of the belt 91 (no image formation area), which corresponds to the paper interval, was contaminated by the expelled toner. However, before the contaminated area of the belt 91 reached the charge roller, the expelled toner on the belt 91 was collected in the image formation station PBk having the cleaning blade. Therefore, the secondary transfer roller 10 was not contaminated by the expelled toner, even through it was not separated from the belt 91.

Further, the average image printing ratio of the image formation station PBk having the cleaning blade was low. However, the above-mentioned expelled toner was collected in the image formation station PBk. Therefore, neither was the cleaning blade 109*b* dragged into the interface between the blade and photosensitive drum, nor vibrated.

Thus, the image forming apparatus yielded satisfactory images until the output count reached 50,000.

Embodiment 3

In this embodiment, the actual average image printing ratio $\alpha 2$, which was 40% in the first embodiment, was changed to 30%, and the limit value a was changed from 30% to 10%. Otherwise, the tests conditions were the same as those in the first embodiment. Also in this embodiment, 50,000 sheets of copy were printed.

Also in this embodiment, as the actual average image printing ratio $\alpha 2$ exceeded the limit value $\alpha 1$ for the average image printing ratio, the process of expelling toner from the auxiliary charging means 7 and 6 was carried out every 100 sheets. As a result, the paper interval area of the belt 91 (no image formation area) was contaminated by the expelled toner. However, before the contaminated area of the belt 91 reached the charge roller, the expelled toner on the belt 91 was collected in the image formation station PBk having the cleaning blade. Therefore, the secondary transfer roller 10 was not contaminated by the expelled toner, even through it was not separated from the belt 91.

The average image printing ratio of the image formation station PBk having the cleaning blade was low. However, the above-mentioned expelled toner was collected in the image formation station PBk. Therefore, neither was the cleaning blade 109*b* dragged into the interface between the blade and photosensitive drum, nor vibrated.

Thus, the image forming apparatus yielded satisfactory images until the output count reached 50,000.

Embodiment 4

In this embodiment, the actual average image printing ratio $\alpha$2, which was 40% in the first embodiment, was changed to 30%, and the limit value $\alpha$1 was changed from 30% to 5%. Otherwise, the test conditions were the same as those in the first embodiment. Also in this embodiment, 50,000 sheets of copy were printed.

Also in this embodiment, as the actual average image printing ratio $\alpha$2 exceeded the limit value $\alpha$1 for the average image printing ratio, the process of expelling toner from the auxiliary charging means 7 and 6 was carried out every 100 sheets. As a result, the paper interval area of the belt 91 (no image formation area) was contaminated by the expelled toner. However, before the contaminated area of the belt 91 reached the charge roller, the expelled toner on the belt 91 was collected in the image formation station PBk having the cleaning blade. Therefore, the secondary transfer roller 10 was not contaminated by the expelled toner, even through it was not separated from the belt 91.

The average image printing ratio of the image formation station PBk having the cleaning blade was low. However, the above-mentioned expelled toner was collected in the image formation station PBk. Therefore, neither was the cleaning blade 109*b* dragged into the interface between the blade and photosensitive drum, nor vibrated.

Thus, the image forming apparatus yielded satisfactory images until the output count reached 50,000.

Embodiment 5

In this embodiment, the actual average image printing ratio $\alpha$2, which was 40% in the first embodiment, was changed to 10%, and the limit value $\alpha$1 was changed from 30% to 5%. Further, the actual average image printing ratio $\beta$2 was changed from 5% to 0.5%, and the limit value $\beta$1 was changed from 10% to 5%. Otherwise, the tests conditions were the same as those in the first embodiment. Also in this embodiment, 50,000 sheets of copy were printed.

Also in this embodiment, as the actual average image printing ratio $\alpha$2 exceeded the limit value $\alpha$1 for the average image printing ratio, the process of expelling toner from the auxiliary charging means 7 and 6 was carried out every 100 sheets. As a result, the paper interval area of the belt 91 (no image formation area) was contaminated by the expelled toner. However, before the contaminated area of the belt 91 reached the charge roller, the expelled toner on the belt 91 was collected in the image formation station PBk having the cleaning blade. Therefore, the secondary transfer roller 10 was not contaminated by the expelled toner, even through it was not separated from the belt 91.

Further, the average image printing ratio of the image formation station PBk having the cleaning blade was low. However, the above-mentioned expelled toner was collected in the image formation station PBk. Therefore, the cleaning blade 109*b* was neither dragged into the interface between the blade and photosensitive drum, nor vibrated.

Thus, the image forming apparatus yielded satisfactory images until the output count reached 50,000.

Comparative Embodiment 1

This comparative embodiment is comparable to the above described first embodiment, except that the printing tests was conducted without collecting the toner expelled onto the belt 91 from the cleaner-less image formation stations, by the image formation station PBk having the cleaning blade.

As the actual average image printing ratio $\alpha$2 exceeded the limit value $\alpha$1 for the average image printing ratio, the process of expelling toner from the auxiliary charging means 7 and 6 was carried out every 100 sheets. However, the toner expelled onto the belt 91 was not collected in the image formation station PBk having the cleaning blade. Consequently, the above-mentioned secondary transfer roller 10 was contaminated by the expelled toner, resulting in the yielding of sheets of copy contaminated on the reverse side.

Comparative Embodiment 2

This comparative embodiment is also comparable to the first embodiment, except that the control for periodically causing the auxiliary charging means 7 and 6 of the cleaner-less image formation stations to expel toner was not executed.

Thus, toner was not periodically expelled from the auxiliary charging means 7 and 6. Therefore, the image formation station PBk (downstream image formation station) having the cleaning blade was not provided with the expelled toner which would have functioned as a lubricant. Consequently, the cleaning edge of the cleaning blade was dragged into the interface between the cleaning blade and photosensitive drum.

FIG. 5 is a table summarizing the results of the evaluation of the images yielded under the printing conditions in the above described first-fourth embodiments, and first and second comparative embodiments.

Comparative Embodiment 3

This comparative embodiment is also comparable to the above-described first embodiment, except that the actual average image printing ratio $\alpha$2 was changed from 40% to 10%. Otherwise, the tests conditions were the same as those in the first embodiment. Also in this comparative embodiment, 50,000 sheets of copy were printed.

In this comparative embodiment, the actual image printing ratio $\alpha$2 of the cleaner-less image formation station did not exceed the limit value $\alpha$1 for the average image printing ratio, above which the process of expelling toner was to be carried out. Therefore, toner was not expelled from the auxiliary charging means 7 and 6.

Therefore, no toner is supplied from the cleaner-less image formation stations to the image formation station PBk having the cleaning blade 109*b* which needed to be supplied with toner (expelled toner). As a result, the cleaning edge of the blade 109*b* was dragged into the interface between the blade 109*b* and photosensitive drum 1.

Comparative Embodiment 4

Printing tests, in which the above-mentioned image forming apparatus is used in the black monochromatic mode to print 50,000 copies of the following test image, were carried out in an ambient environment which were normal in both temperature and humidity. More specifically, each of the image formation stations PY, PM, and PC, that is, the cleaner-less image formation stations, of the image forming apparatus described above was used in the black monochromatic mode to print 50,000 copies of the following test image. The test image used for the tests was 0% in the actual average image printing ration α2 (per 100 A4 sheets of copy) of the cleaner-less image formation station, and 5% in the actual average image printing ratio β2 of the image formation station PBk having the cleaning blade. Further, 100 copies which were 10% and 5% in the actual average image printing ratios α2 and α2, were printed every 5,000 copies. Also in this embodiment, 50,000 copies of A4 size were printed.

The above-mentioned actual average image printing ratios α2 and β2 were measured using a video count control system.

The printing tests were carried out under the following conditions. That is, the limit value α1 for the average image printing ratio (per 100 A4 sheets of copy) for the cleaner-less image formation station, above which the process of causing the cleaner-less image formation station to expel toner is to be carried out, was set to 30%, and the limit value β1 for the average image printing ratio (per 100 A4 sheets of copy) for the image formation station PBk having the cleaning blade, above which the process of causing the image formation station PBk having the cleaning blade to collect the expelled toner is to be carried out was set to 10%. The abovementioned limit values α1 and β1 were stored as comparative values in the control circuit 130.

Also in this comparative embodiment, the actual image printing ratio α2 of the cleaner-less image formation station did not exceed the limit value α1 for the average image printing ratio, above which the process of expelling toner is to be carried out. Therefore, the process of expelling toner from the auxiliary charging means 7 and 6 was not carried out.

Therefore, no toner is supplied at all from the cleaner-less image formation stations to the image formation station PBk having the cleaning blade 109*b*, even though the blade 109*b* needed to be supplied with toner (expelled toner). As a result, the cleaning edge of the blade 109*b* was dragged into the interface between the blade 109*b* and photosensitive drum 1 in the black monochromatic mode.

FIG. 6 is a table summarizing the results of the evaluation of the images yielded under the printing conditions in the above-described third and fourth comparative embodiments.

Embodiment 6

Printing tests, in which the above-mentioned image forming apparatus is used in the black monochromatic mode to print 50,000 copies of the following test image, were carried out in an ambient environment which were normal in both temperature and humidity. More specifically, each of the image formation stations PY, PM, and PC, that is, the cleaner-less image formation stations, of the image forming apparatus described above was used in the black monochromatic mode to print 50,000 copies of the following test image. The test image used for the tests was 0% in the actual average image printing ration α2 (per 100 A4 sheets of copy) of the cleaner-less image formation station, and 5% in the actual average image printing ratio β2 of the image formation station PBk having the cleaning blade. Further, 100 copies which were 10% and 5% in the actual average image printing ratios α2 and β2, were printed every 5,000 copies.

The above-mentioned actual average image printing ratios α2 and β2 were measured using a video count control system.

The printing tests were conducted under the following conditions. That is, the limit value α1 for the average image printing ratio (per 100 sheets of A4 size) for the cleaner-less image formation station, above which the process of expelling toner is to be carried out, was set to 30%, and the limit value β1 for the average image printing ratio (per 100 sheets of A4 size) for the image formation station PBk having the cleaning blade, above which the image formation station PBk collects the expelled toner, was set to 10%. The above-mentioned limit values α1 and β1 were set as comparative values in the control circuit 130.

The actual average printing ratios α2 did not reach the limit value α1. Normally, the process of expelling toner was not to be carried out in this situation. However, when the actual printing ratio β2 did not reach the limit value β1, the process of expelling toner was forced to be carried out, and also, the process of collecting the expelled toner in the image formation station PBk having the cleaning blade was also forced to be carried out.

Further, the toner expelling process was carried out under the following condition: the length of time t for which toner is to be expelled was set to satisfy the following equation: $t=t1\times(1-\beta2/\beta1)$, in which t1 stands for the normal length of time for which toner is to be expelled.

That is, when the actual printing ratio β2 did not reach the limit value β1, the process of expelling toner was forced to be carried out. The toner expulsion time was reduced from the normal toner expulsion time t1 to t ($=t1\times(1-\beta2/\beta1)$).

Further, the timing with which the toner was expelled from the auxiliary charging means 7 and 6 of the cleaner-less image formation station was such timing that, when the no image formation area of the belt 91, that is, the area of the belt 91 other than the area of the belt 9 across which images are formed by transfer, reaches the primary transfer station d, the toner expelled onto the no image formation area of the photosensitive drum 1 of the same image forming station can be transferred onto the belt 91.

The actual average printing ratios α2 did not reach the limit value α1. However, the process of expelling toner from the auxiliary charging means 7 and 6 was forced to be carried out anyway, and the process of collecting the expelled toner in the image formation station PBk having the cleaning blade was also forced to be carried out anyway. Therefore, the cleaning blade was supplied with enough toner to sufficiently lubricate the cleaning blade. Therefore, neither was the cleaning edge of the cleaning blade dragged into the interface between the cleaning blade and photosensitive drum, nor vibrated. Therefore, the image forming apparatus continuously yielded satisfactory sheets of copy until the copy count reached 50,000.

Incidentally, when the image forming apparatus is operated in the black monochromatic mode, or is operated for a job which is low in color image ratio, the amount by which toner is expelled from the cleaner-less color image formation stations may be controlled. The employment of this control prevents the entire toner from being wastefully expelled. Therefore, even if the image forming apparatus is continuously operated for a certain length of time in the black monochromatic mode, the cleaning blade will be provided with at least the minimum amount of toner necessary for its lubrication.

Embodiment 7

In this embodiment, the actual average image printing ratio β2, which was 5% in the fifth embodiment, was changed to 7.5%. Also in this embodiment, as the actual average image printing ratio α2 did not reach the limit value α1. Normally, therefore, the process of expelling toner was not to be carried out. However, an arrangement was made so that when the actual printing ratio $\beta 2$ did not reach the limit value $\beta 1$, the process of expelling toner and collecting the toner in the image formation station PBk having the cleaning blade was forced to be carried out.

Further, such control was executed that an image forming station which was highest in the average image printing ratio was selected among the image formations stations in which toner was expelled, and the process of expelling toner was carried out only in the selected image formation station. In addition, the length of time t for which the process of expelling toner is to be carried out was set so that the following equation was satisfied: $t=N\times[t1\times(1-\beta 2/\beta 1)]$, in which t1 stands for the normal length of time the process of expelling toner is to be carried out, and N stands for the number of cleaner-less image formation stations.

In other words, when $\beta 1$ was not reached, the process of expelling toner was sequentially carried out in the cleaner-less image formation stations, in the descending order starting from the image formation station which is highest in the cumulative value of the toner expulsion image density, and the length of time for which the process of expelling toner is to be carried out was reduced from the normal length of time t1 for the toner expulsion to $t=N\times[t1\times(1-\beta 2/\beta 1)]$.

Further, the timing with which the toner was expelled from the auxiliary charging means 7 and 6 of the cleaner-less image formation station was such a timing that, when the no image formation area of the belt 91, that is, the area of the belt 91 other than the area of the belt 9 across which images are formed by transfer, reached the primary transfer station d, the toner having been expelled onto the no image formation area of the photosensitive drum 1 of the same image forming station can be transferred onto the belt 91.

The actual average printing ratios $\alpha 2$ did not reach the limit value $\alpha 1$. However, the process of expelling toner from the auxiliary charging means 7 and 6 was forced to be carried out, and the process of collecting the expelled toner in the image formation station PBk having the cleaning blade was also carried out. Therefore, the cleaning blade was supplied with a sufficient amount of toner for satisfactorily lubricating the cleaning blade. Therefore, the cleaning edge of the cleaning blade was neither dragged into the interface between the cleaning blade and photosensitive drum, nor vibrated. Therefore, the image forming apparatus continuously yielded satisfactory sheets of copy until the copy count reached 50,000.

Incidentally, when the image forming apparatus is operated in the black monochromatic mode, or is operated for a job which is low in color image ratio, the amount by which toner is expelled from the cleaner-less color image formation stations may be controlled. The employment of this control prevents the toner in the color image formation stations from being wasted by being expelled all at once. Therefore, even if the image forming apparatus is continuously operated for a certain length of time in the black monochromatic mode, the cleaning blade will be provided with at least the minimum amount of toner necessary for its lubrication.

Comparative Embodiment 5

Printing tests, in which the above-mentioned image forming apparatus is used in the black monochromatic mode to print 50,000 copies (A4 size) of the following test image, were carried out in an ambient environment which were normal in both temperature and humidity. More specifically, each of the image formation stations PY, PM, and PC, that is, the cleaner-less image formation stations, of the image forming apparatus described above was used in the black monochromatic mode to print 50,000 copies of the following test image. The test image used for the tests was 0% in the actual average image printing ration $\alpha 2$ (per 100 A4 sheets of copy) of the cleaner-less image formation station, and 5% in the actual average image printing ratio $\beta 2$ of the image formation station PBk having the cleaning blade. Further, 100 copies which were 30% and 5% in the actual average image printing ratios $\alpha 2$ and $\beta 2$, were printed every 5,000 copies.

The above-mentioned actual average image printing ratios $\alpha 2$ and $\beta 2$ were measured using a video count control system.

The printing tests were conducted under the following conditions. That is, the limit value $\alpha 1$ for the average image printing ratio (per 100 sheets of A4 size) for the cleaner-less image formation station, above which the process of expelling toner is to be carried out, was set to 30%, and the limit value $\beta 1$ for the average image printing ratio (per 100 sheets of A4 size) for the image formation station PBk having the cleaning blade, above which the image forming apparatus PBk is to collect the expelled toner, was set to 10%. The above-mentioned limit values $\alpha 1$ and $\beta 1$ were set as comparative values in the control circuit 130.

Also in this (fifth) comparative embodiment, the actual average printing ratios $\alpha 2$ of the cleaner-less image formation station exceeded the limit value $\alpha 1$ above which the process of expelling toner is to be carried out. Therefore, the process of expelling toner from the auxiliary charging means 7 and 6 was carried out. However, the length of toner expulsion time was not altered.

Therefore, the image formation station PBk having the cleaning blade was not supplied with a sufficient amount of the toner from the cleaner-less image formation stations, even though the cleaning blade 109*b* needed to be supplied with toner. As a result, the cleaning edge of the cleaning blade 109*b* was dragged into the interface between the blade 109*b* and photosensitive drum 1.

FIG. 7 is a table summarizing the results of the evaluation of the images yielded under the printing conditions in the above-described fifth and sixth embodiments, and fifth comparative embodiment.

Figure 8:
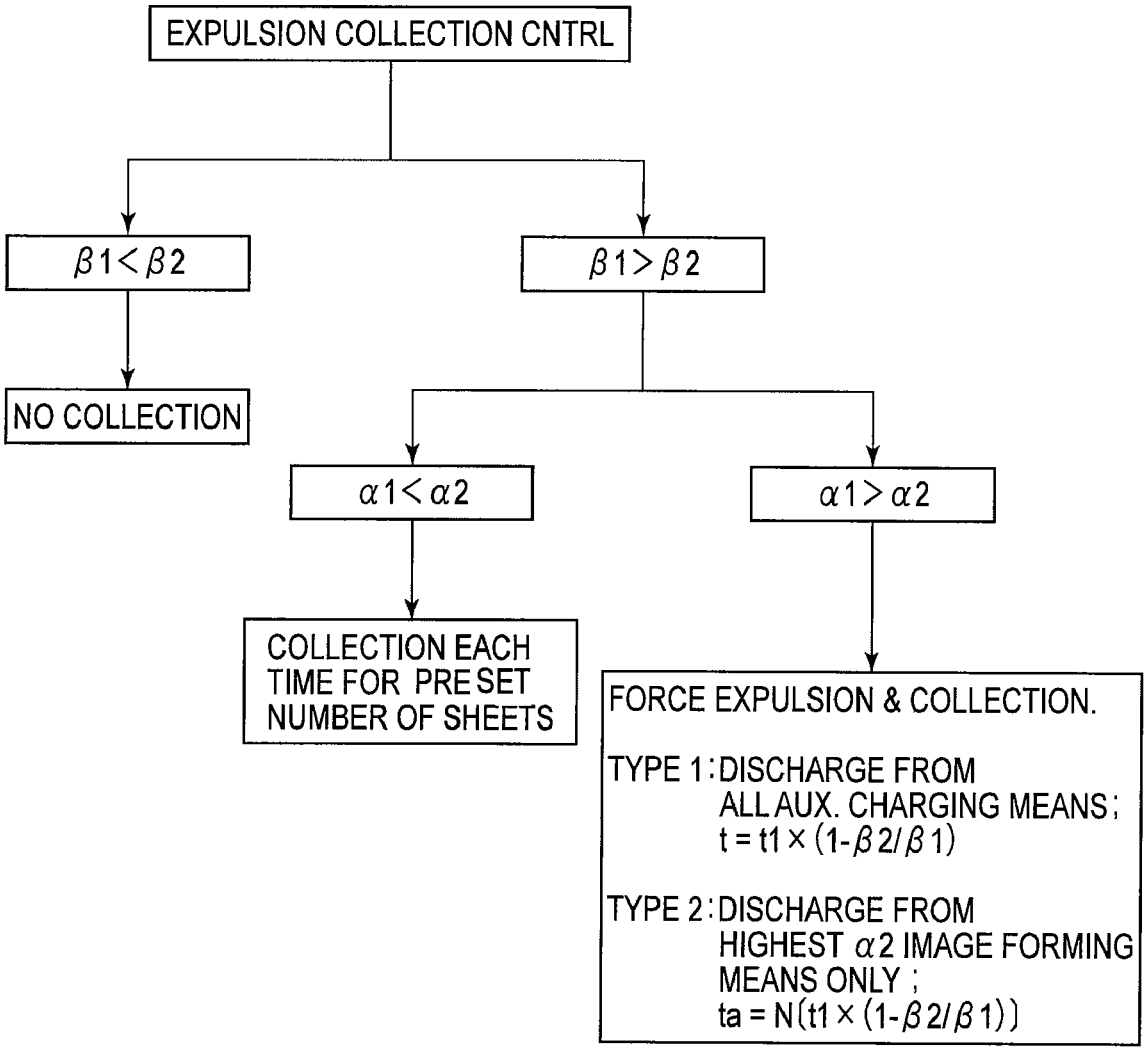
FIG. 8 is a flowchart showing the control, in the preferred and comparative embodiments of the present invention, of the process of expelling toner from the auxiliary charging means of the image forming station having cleaner-less image formation system, and collecting the expelled toner onto the photosensitive drum of the image formation portion having a cleaning apparatus.

FIG. 8 is flowchart of the control of the process of expelling toner from the auxiliary charging means 7 and 6 of the cleaner-less image formation stations, and the control of the process of collecting the expelled toner onto the photosensitive drum in the image forming station having the cleaning apparatus, in the above-described embodiments and comparative embodiment. In this (fifth) comparative embodiment, whether the expelled toner is to be collected by the cleaning station of the image formation station or the cleaning station for cleaning the intermediary transferring member is determined by a part of the control circuit 130 as a collecting station selecting means.

More specifically, the control circuit 130 has an image density calculating means which detects the image density of each image output, accumulates the detected image densities, and calculates the average image printing ratio per preset number of sheets of image output. The process of expelling toner from the auxiliary charging means of the cleaner-less image formation stations is as follows. That is, it is carried out as the average image printing ratio $\alpha 2$, which is calculated per preset number of sheets of copy by the image density calculating means exceeds a preset value $\alpha 1$. On the other hand, when the average image printing ratio $\beta 2$, per preset number of sheets of copy, of the image formation station having the cleaning apparatus is no more than a preset value $\beta 1$, the abovementioned expelled toner is collected in the image formation station having the cleaning apparatus. Further, when $\alpha 2<\alpha 1$, and $\beta 2<\beta 1$ (per preset number of sheets of copy), the above-mentioned auxiliary charging means are forced to expel toner. The expelled toner is collected in the image formation station having the above-mentioned cleaning apparatus.

Incidentally, when $\beta 2<\beta 1$, and the expelled toner is not collected, the expelled toner is collected by the cleaning station for cleaning the intermediary transferring member. In this case, such control as turning off the bias applied to the secondary transfer roller is executed.

Further, the length of time t for which the auxiliary charging means are to be forced to expel toner is set to the value obtained from the following equation: $t=t1\times(1-\beta 2/\beta 1)$, in which $\beta 1$ stands for the limit value for the average image printing ratio (per preset number of sheets of copy) for the image formation station provided with the cleaning apparatus, above which the expelled toner is collected in the image formation station provided with the cleaning apparatus, and $\beta 2$ stands for the actual average image printing ratio (per preset number of sheets of copy) of the image forming apparatus having the cleaning apparatus.

The process of forcing the auxiliary charging means to expel toner is carried out in the image formation station selected as the station highest in the image printing ratio. The length of time ta for which the process is to be carried out in the selected image formation station is set to the value obtained from the following equation: $ta=N\times[t1\times(1-\beta 2/\beta 1)]$, in which $\beta 1$ stands for the limit value for the average image printing ratio (per preset number of sheets of copy) for the image formation station provided with the cleaning apparatus, above which the expelled toner is collected in the image formation station provided with the cleaning apparatus, $\beta 2$ stands for the actual average image printing ratio (per preset number of sheets of copy) of the image forming apparatus having the cleaning apparatus, N stands for the number of the cleaner-less image formation stations, and t1 stands for the length of time for which toner is expelled when $\alpha 2>\alpha 1$.

With the employment of this control, even if the timing with which toner is to be expelled from the auxiliary charging means does not coordinate with the timing with which the cleaning blade is to be supplied with lubrication toner, the expulsion time and/or the image formation station from which toner is to be expelled can be controlled. Therefore, it is possible to supply the cleaning blade with a sufficient amount of lubrication toner to maintain its performance.

It is when the image forming apparatus is operating in the black monochromatic mode that the process of expelling toner from the auxiliary charging means of the cleaner-less image formation stations is carried out with the following timing. That is, it is carried out with such timing that the toner expelled onto the no image formation area of the image bearing member can be transferred onto the above-mentioned intermediary transferring member when the no image formation area of the intermediary transferring member, that is, the area of the intermediary transferring member, which is other than the area across which an image is expected to be formed by transfer, reaches the primary transferring means (station).

That is, currently, the number of the users who are low in the color ratio, that is, the users who are high in the frequency with which they use image forming apparatuses, in the black monochromatic mode, is large. Therefore, it is very important to reduce the image forming apparatuses in the operational cost in the black monochromatic mode.

In order to extend the life of the black image formation station, a photosensitive drum, such as the one based on amorphous silicon, which is less susceptible to frictional wear, is employed as the image bearing member of the black image formation station. Further, in order to reduce the cost of the toner used by the black image formation station, single-component black toner is used as developer. The present invention makes it possible to keep the cleaning blade of the abovementioned image formation station fully lubricated, without causing downtime, even if an image forming apparatus is structured as described above. In other words, not only does this embodiment of the present invention make it possible to reduce the operational cost of an image forming apparatus in the black monochromatic mode, but also, to reliably form satisfactory images.

In this embodiment, the image forming apparatus is structured so that the collection of the expelled toner is optional. Therefore, even if an image forming apparatus is structured like the one in this embodiment, this embodiment makes it possible to reduce the amount of toner which passes the secondary transfer station. Therefore, not only can it reduce the chances that the length of time necessary to expel toner and collect the expelled toner will become longer, but also, to reduce the amount by which the secondary transfer station is contaminated.

In the above-described preferred embodiments, the image forming apparatus was provided with the intermediary transferring member. However, the present invention is also applicable to image forming apparatuses which employ a recording medium conveying belt, instead of a conventional rotational transferring member, and the effects of such application are the same as those described above.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 253599/2005 filed Sep. 1, 2005 which is hereby incorporated by reference.

What is claimed is:

1. An image forming apparatus comprising:

a first image forming station including a first image bearing member and developing means for developing an electrostatic image formed on said first image bearing member with toner, wherein the toner remaining on said first image bearing member after a developed image is transferred, is collected by said developing means;

a transfer rotatable member;

a first cleaning member for removing toner from said transfer rotatable member;

a second image forming station including a second image bearing member and developing means for developing an electrostatic image formed on said second image bearing member with toner, a second cleaning member for removing the toner remaining on said second image bearing member after a developed image is transferred, wherein said second image forming station is disposed downstream of said first image forming station and upstream of said first cleaning member with respect to a peripheral moving direction of rotation of said transfer rotatable member; and collection control means for performing a control operation to collect, by said second cleaning member of said second image forming station, the toner discharged to said transfer rotatable member from said first image forming station during a non-image-formation period.

2. An apparatus according to claim 1, further comprising a plurality of image forming stations each including an image bearing member, developing means for developing an electrostatic image formed on said image bearing member with toner, wherein the toner remaining on said image bearing member after a developed image is transferred is collected by said developing means, and wherein said second image forming station is disposed at the most downstream position with respect to a peripheral moving direction of rotation of said transfer rotatable member.

3. An apparatus according to claim 1, wherein said first image forming station further includes an auxiliary charging member for being supplied with a voltage having a polarity which is the same as a regular toner polarity to electrically charge the toner remaining on said first image bearing member after the developed image is transferred, and said collection control means discharges the toner stagnating in said auxiliary charging member from said first image bearing member to said transfer rotatable member and the toner is collected by said second cleaning member.

4. An apparatus according to claim 1, wherein said second image forming station forms a black toner image.

5. An apparatus according to claim 1, wherein said second image bearing member in said second image forming station includes a surface layer of amorphous silicon.

6. An apparatus according to claim 1, wherein said transfer rotatable member is an intermediary transfer member onto which the toner image is transferred from said image forming stations, and wherein said first image forming station and said second image forming station each include a primary transfer member for transferring the toner image from the associated image bearing member onto said transfer rotatable transfer member, and a secondary transfer member for transferring the toner image from said transfer rotatable member onto the recording material.

7. An apparatus according to claim 6, wherein the toner discharged onto said transfer rotatable member is collected by said second image bearing member of second image forming station by application of a voltage having a polarity opposite the regular toner polarity to said primary transferring means of said second image forming station.

8. An apparatus according to claim 6, wherein the toner discharged onto said transfer rotatable member is collected by said second image bearing member of said second image forming station by application of a voltage having a polarity opposite the regular toner polarity to said primary transferring member of said second image forming station and wherein the voltage applied to said primary transferring member is larger than a voltage applied thereto during an image forming operation period in absolute value.

9. An apparatus according to claim 1, further comprising collection selecting means for selecting whether to effect the collection by said collection control means.

10. An apparatus according to claim 9, further comprising image density calculating means for detecting image densities of output images and integrating the image densities and calculating an average image print ratio for each of predetermined numbers of output images, wherein said collection selecting means effects the toner collection when the average image print ratio $\beta 2$ calculated by said image density calculating means in said second image forming station is smaller than a predetermined value $\beta 1$ in the predetermined number of the output images.

11. An image forming apparatus comprising:

a first image forming station including a first image bearing member and developing means for developing an electrostatic image formed on said first image bearing member with toner, wherein the toner remaining on said first image bearing member after a developed image is transferred, is collected by said developing means;

an intermediary transfer member for carrying a toner image transferred from said first image bearing member;

a second transfer member for transferring the toner image from said intermediary transfer member onto a recording material; and a second image forming station including a second image bearing member and developing means for developing an electrostatic image formed on said second image bearing member, and a cleaning member for removing the toner remaining on said second image bearing member, wherein said second image forming station is disposed downstream of said first image forming station and upstream of said second transfer member with respect to a peripheral moving direction of rotation of said intermediary transfer member, wherein said apparatus is operable in a collection mode in which the toner discharged from said first image forming station to said intermediary transfer member during a non-image-formation period is collected by said cleaning member of said second image forming station.

12. An apparatus according to claim 11, further comprising a plurality of image forming stations each including an image bearing member, developing means for developing an electrostatic image formed on said image bearing member with toner, wherein the toner remaining on said image bearing member after a developed image is transferred is collected by said developing means, and wherein said second image forming station is disposed at the most downstream position with respect to a peripheral moving direction of rotation of said intermediary transfer member.

13. An apparatus according to claim 11, wherein said first image forming station further includes an auxiliary charging member for being supplied with a voltage having a polarity which is the same as a regular toner polarity to electrically charge the toner remaining on said first image bearing member after the developed image is transferred, and in the collection mode, the toner stagnating in said auxiliary charging member is discharged from said first image bearing member to said intermediary transfer member and the toner is collected by said cleaning member.

14. An apparatus according to claim 11, wherein said second image forming station forms a black toner image.

15. An apparatus according to claim 11, wherein said second image bearing member in said second image forming station includes a surface layer of amorphous silicon.

16. An apparatus according to claim 11, wherein in the collection of the toner from said intermediary transfer member to said second image bearing member of said second image forming station, a voltage having a polarity opposite the regular toner polarity is applied to said intermediary transfer member which transfers the toner image from said intermediary transfer member onto said second image bearing member of said second image forming station.

17. An apparatus according to claim 11, wherein in the collection of the toner from said intermediary transfer member to said second image bearing member of the second image forming station, a voltage having a polarity opposite the regular toner polarity is applied to said intermediary transfer member which transfers the toner image from said intermediary transfer member onto said second image bearing member of said second image forming station and wherein the voltage is larger than a voltage applied thereto during an image forming operation period in absolute value.

18. An apparatus according to claim 11, further comprising collection selecting means for selecting whether to effect the collection by said collection control means.

19. An apparatus according to claim 18, further comprising image density calculating means for detecting image densities of output images and integrating the image densities and calculating an average image print ratio for each of predetermined numbers of output images, wherein collection selecting means effects the toner collection when the average image print ratio β2 calculated by said image density calculating means in said second image forming station is smaller than a predetermined value β1 in the predetermined number of the output images.

* * * * *